US005220629A

United States Patent [19]

Kosaka et al.

[11] Patent Number: 5,220,629

[45] Date of Patent: Jun. 15, 1993

[54] SPEECH SYNTHESIS APPARATUS AND METHOD

[75] Inventors: Tetsuo Kosaka; Atsushi Sakurai, both of Yokohama; Junichi Tamura; Yasunori Ohora, both of Tokyo; Takeshi Fujita; Takashi Aso, both of Yokohama; Katsuhiko Kawasaki, Machida, all of Japan

[73] Assignee: Canon Kabushiki Kaisha, Tokyo, Japan

[21] Appl. No.: 608,757

[22] Filed: Nov. 5, 1990

[30] Foreign Application Priority Data

| | | | |
|---|---|---|---|
| Nov. 6, 1989 | [JP] | Japan | 1-289735 |
| Dec. 27, 1989 | [JP] | Japan | 1-343470 |
| Dec. 29, 1989 | [JP] | Japan | 1-343112 |
| Dec. 29, 1989 | [JP] | Japan | 1-343113 |
| Dec. 29, 1989 | [JP] | Japan | 1-343119 |
| Dec. 29, 1989 | [JP] | Japan | 1-343127 |

[51] Int. Cl.[5] ..... G10L 5/00

[52] U.S. Cl. ..... 381/52

[58] Field of Search ..... 381/52, 51; 395/2

[56] References Cited

U.S. PATENT DOCUMENTS

| | | | |
|---|---|---|---|
| 4,596,032 | 6/1986 | Sakurai | 381/51 |
| 4,642,012 | 11/1986 | Lin et al. | 381/52 X |
| 4,797,930 | 1/1989 | Goudie | 381/52 |
| 4,802,226 | 1/1989 | Watanabe | 381/43 |
| 4,896,359 | 1/1990 | Yamamoto et al. | 381/52 |
| 4,907,279 | 3/1990 | Higuchi et al. | 381/52 |
| 4,908,867 | 3/1990 | Silverman | 381/51 |
| 4,975,957 | 12/1990 | Ichikawa et al. | 381/52 X |

FOREIGN PATENT DOCUMENTS 1922170 11/1969 Fed. Rep. of Germany .

OTHER PUBLICATIONS

U.S. application Ser. No. 07/492,071 filed Mar. 12, 1990.

U.S. application Ser. No. 07/490,462 filed Mar. 8, 1990.

U.S. application Ser. No. 07/549,245 filed Jul. 9, 1990.

U.S. application Ser. No. 07/770,136 filed Oct. 2, 1991.

U.S. application Ser. No. 07/904,906 filed Jun. 25, 1992.

U.S. application Ser. No. 07/608,376 filed Nov. 2, 1990.

U.S. application Ser. No. 07/599,882 filed Oct. 19, 1990.

Japan Telecommunications Review, "Shared Audio Information System Using New Audio Response Unit," Y. Imai, et al., vol. 23, No. 4, Tokyo, Japan, Oct. 1981, pp. 383-390.

IEEE International Conference on Acoustics, Speech and Signal Processing, "The Speech Synthesis System for An Unlimited Japanese Vocabulary," T. Yazu, et al., Tokyo, Japan, Apr. 7-11, 1986, New York, pp. 2019-2022.

Speech Communication, "Diphone Speech Synthesis", O'Shaughnessy, et al., vol. 7, No. 1, Mar. 1988, Elsevier Science Publishers B.V., Amsterdam, NL, pp. 55-65.

European Conference on Speech Technology, "Methods for the Simulation of Natural Intonation in the 'Syrub' Text-to-Speech System for Unrestricted German Text," Kugler-Kruse, et al., vol. 2, Sep. 1987, Edinburg, GB, pp. 177-180.

IBM Technology Disclosure Bulletin, "Method for Connecting Speech Synthesis Units," vol. 31, No. 8, Jan. 1989, pp. 147-149, Armonk, New York.

*Primary Examiner*—Emanuel S. Kemeny

*Attorney, Agent, or Firm*—Fitzpatrick, Cella, Harper & Scinto

[57] ABSTRACT

A method and apparatus for reading out a feature parameter and a driver sound source stored in a VCV (vowel-consonant-vowel) speech segment file, sequentially connecting the readout parameter and the readout sound source information in accordance with a predetermined rule, and supplying connected data to a speech synthesizer, thereby generating a speech output, includes a memory for storing the average power of each vowel, and a power controller for controlling the apparatus to normalize a VCV speech segment so that powers at both ends of each VCV segment coincide with the average power of each vowel.

34 Claims, 29 Drawing Sheets

FIG. 25A
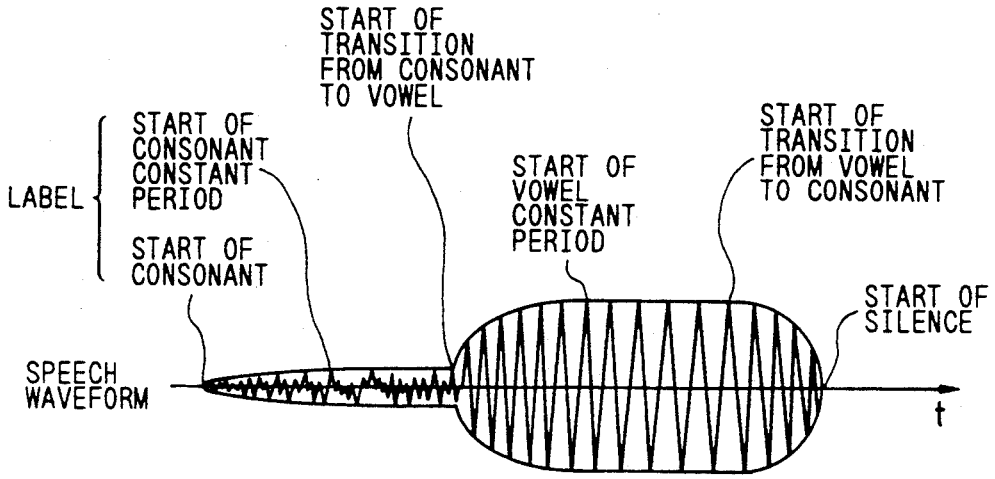
FIG. 25B
FIG. 25C
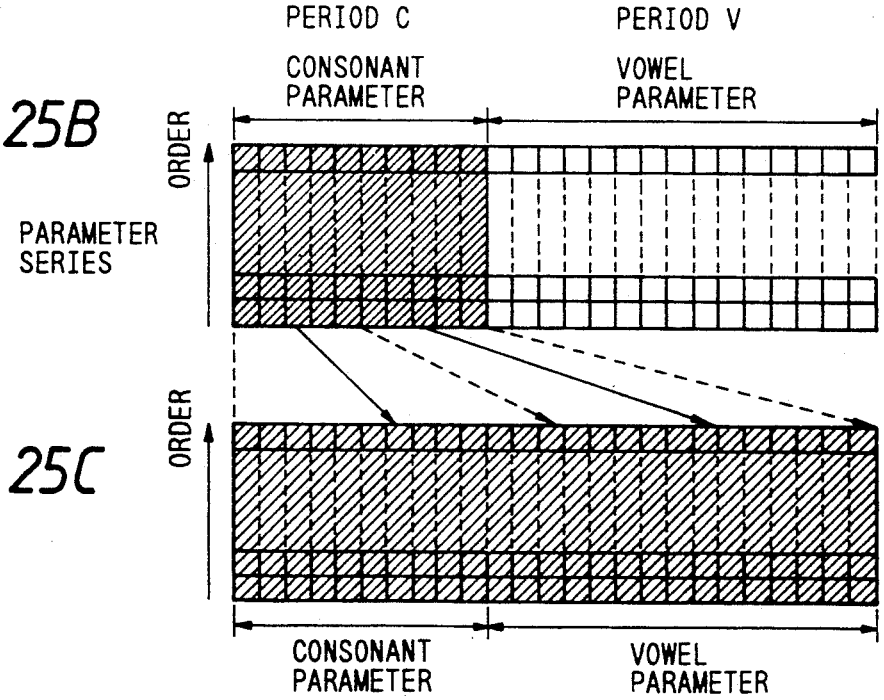

SPEECH SYNTHESIS APPARATUS AND METHOD

BACKGROUND OF THE INVENTION

1. Field of the Invention

The present invention relates to a rule speech synthesis apparatus and method for performing speech synthesis by connecting parameters for speech segments by rules.

2. Related Background Art

A speech rule synthesis apparatus is available as an apparatus for generating speech from character train data. A feature parameter (e.g., LPC, PARCOR, LSP, or Mel Cepstrum; to be referred to as a parameter hereinafter) of a speech segment registered in a speech segment file in accordance with information of character train data is extracted and combined with a driver sound source signal (i.e., an impulse train in a voiced speech period and noise in a voiceless speech period) in accordance with a rate for generating synthesized speech. A composite result is supplied to a speech synthesizer to obtain synthesized speech. Types of speech segments are generally, a CV (consonant-vowel) segment, a VCV (vowel-consonant-vowel) segment, and a CVC (consonant-vowel-consonant) segment.

In order to synthesize speech segments, parameters must be interpolated. Even during interpolation performed when a parameter is abruptly changed, speech segments are simply connected by a line in an interpolation period according to a conventional technique, so that spectral information inherent to the speech segments is lost, and the resultant speech may be changed. In the conventional technique, a portion of speech uttered as a word or sentence is extracted as a period used as a speech segment.

For this reason, depending on the conditions under which human speech is synthesized from speech segments, speech powers greatly vary, and a gap is formed between the connected speech segments. As a result, synthesized speech sounds strange.

In a conventional method, when speech segments are to be connected in accordance with a mora length changed by the utterance speed of synthesized speech, a vowel, a consonant, and a transition portion between the vowel and the consonant are not considered separately and the entire speech segment data is expanded/compressed (reduced) at a uniform rate.

However, when parameters are simply expanded/reduced and connected to coincide with a syllable-beat-point pitch, vowels whose lengths tend to be changed with the utterance speed, phonemes /S/ and /F/, and explosive phonemes /P/ and /T/ are uniformly expanded/reduced without discriminating them from each other. The resultant synthesized speech is unclear and cannot be easily heard.

Durations of Japanese syllables are almost equal to each other. When speech segments are to be combined, parameters are interpolated to uniform syllable-beat-point pitches, and the resultant synthesized speech rhythm becomes unnatural.

A vowel may become voiceless depending on the preceding and following phoneme conditions. For example, when a word "issiki" is produced, the vowel "i" between "s" and "k" becomes voiceless. This can be achieved by rule synthesis in a conventional technique so that when the vowel /i/ of the syllable "shi" is to be synthesized, the driver sound source signal is changed into noise for synthesizing a voiceless sound from an impulse train for synthesizing a voiced sound without changing the parameter, thereby obtaining a voiceless sound.

The feature parameter of the voiced sound which is to be synthesized by an impulse sound source is forcibly synthesized by a noise sound source, and the synthesized speech becomes unnatural.

For example, when a rule synthesis apparatus using a VCV segment as a speech segment has six vowels and 25 consonants, 900 speech segments must be prepared, and a large-capacity is required. As a result, the apparatus becomes bulky.

There are three types of accents, i.e., a strongest stress start type, a strongest stress center type, and a flat type. For example, each of the strongest stress start and center type accents has three magnitudes, and the flat type accent has two magnitudes. The accent corresponding to the input text is determined by only a maximum of three magnitudes determined by the accent type. A dictionary is prestored with accent information.

In a conventional technique, the type of accent cannot be changed at the time of text input, and a desired accent is difficult to output.

A conventional arrangement having no dictionary of accent information corresponding to the input text to input the text together with the accent information is available. However, this arrangement requires difficult operations to be performed. It is not easy to understand the rising and falling of the accents by observing only an input text. Accents of a language different from those of Japanese do not coincide with Japanese accent types and are difficult to produce.

SUMMARY OF THE INVENTION

It is an object of the present invention to normalize the power of a speech segment using the average value of powers of vowels of the speech segments as a reference to assure continuity at the time of combination of speech segments, thereby obtaining smooth synthesized speech.

It is another object of the present invention to normalize the power of a speech segment by adjusting the average value of powers of vowels according to a power characteristic of a word or sentence, thereby obtaining synthesized speech in which accents and the like of words or a sentence are more natural and smooth.

It is still another object of the present invention to determine the length of a vowel from a mora length changed in accordance with the utterance speed so as to correspond to a phoneme characteristic, obtaining lengths of transition portions from a vowel to a consonant and from a consonant to a vowel by using the remaining consonants and vowels, and connecting the speech segments, thereby obtaining synthesized speech having a good balance of the length of time between phonemes even if the utterance speed of the synthesized speech is changed.

It is still another object of the present invention to expand/reduce and connect speech segments at an expansion/reduction rate of a parameter corresponding to the type of speech segment, thereby obtaining high-quality speech similar to a human utterance.

It is still another object of the present invention to synthesize speech using an exponential approximation filter and a basic filter of a normalization orthogonal function having a larger volume of information in a low-frequency spectrum, thereby obtaining speech which can be easily understood so as to be suitable for human auditory sensitivity.

It is still another object of the present invention to keep a relative timing interval at the start of a vowel constant in accordance with the utterance speed, thereby obtaining speech suitable for Japanese utterance timing.

It is still another object of the present invention to change a parameter expansion/reduction rate in accordance with whether the length of the speech segment tends to be changed in accordance with a change in utterance speed, thereby obtaining clear high-quality speech.

It is still another object of the present invention to synthesize speech by using a consonant parameter immediately preceding a vowel to be converted into a voiceless sound and a noise sound source as a sound source to synthesize speech when the vowel is to be converted into a voiceless sound, thereby obtaining a more natural voiceless vowel.

It is still another object of the present invention to greatly reduce the storage amount of speech segments by inverting one speech segment and connecting the segment on a time axis to use the result of this process to produce a plurality of speech segments, thereby realizing rule synthesis using a compact apparatus.

It is still another object of the present invention to perform time-axis conversion to use an inverted speech segment along the time axis, thereby obtaining natural speech.

It is still another object of the present invention to input, together with a text, a control character representing a change in accent and utterance speed at the time of text input, thereby easily changing desired states of the accent and utterance speed.

BRIEF DESCRIPTION OF THE DRAWINGS

FIG. 25A is a view showing a speech waveform;

FIG. 25B is a view showing an original parameter series;

FIG. 25C is a view showing a parameter series for obtaining a voiceless vowel from the parameter series shown in FIG. 25B;

DESCRIPTION OF THE PREFERRED EMBODIMENTS

Interpolation by Normalization of Speech Segment

Figure 1:
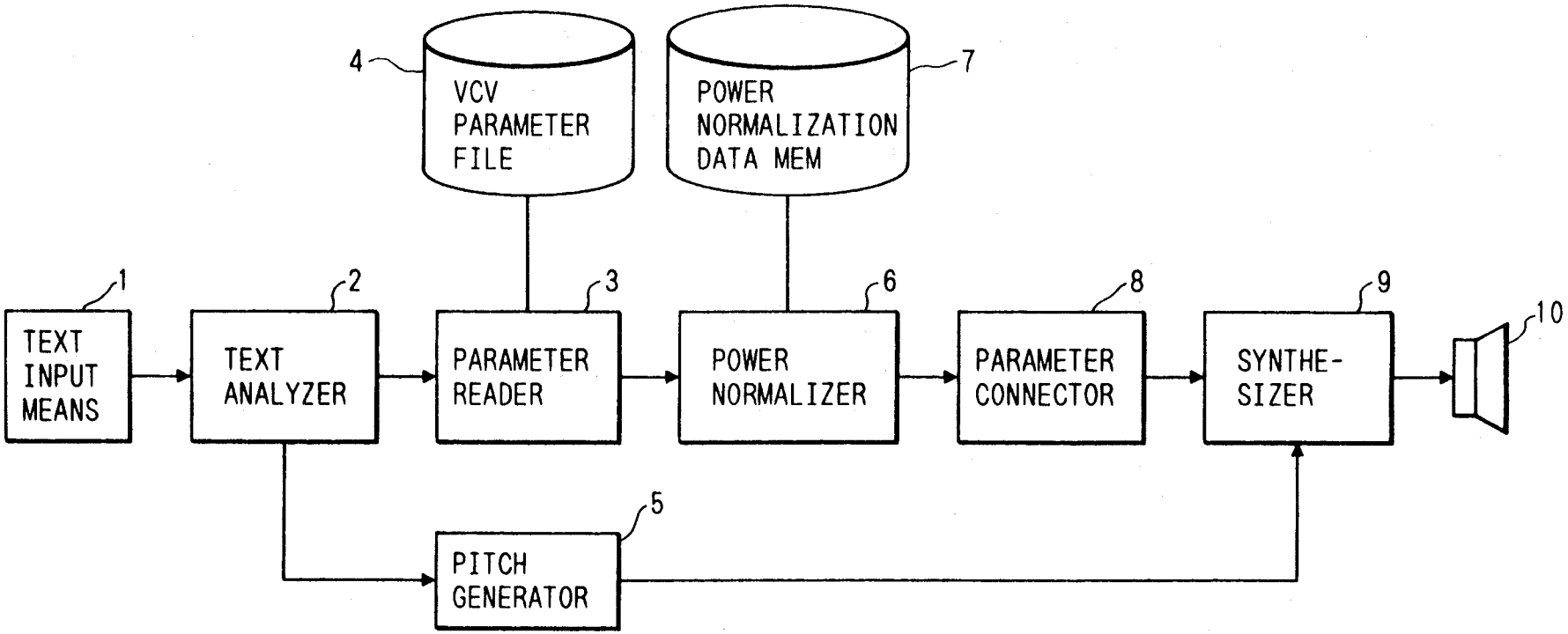
FIG. 1 is a block diagram showing a basic arrangement for performing rule speech synthesis.
Figure 2:
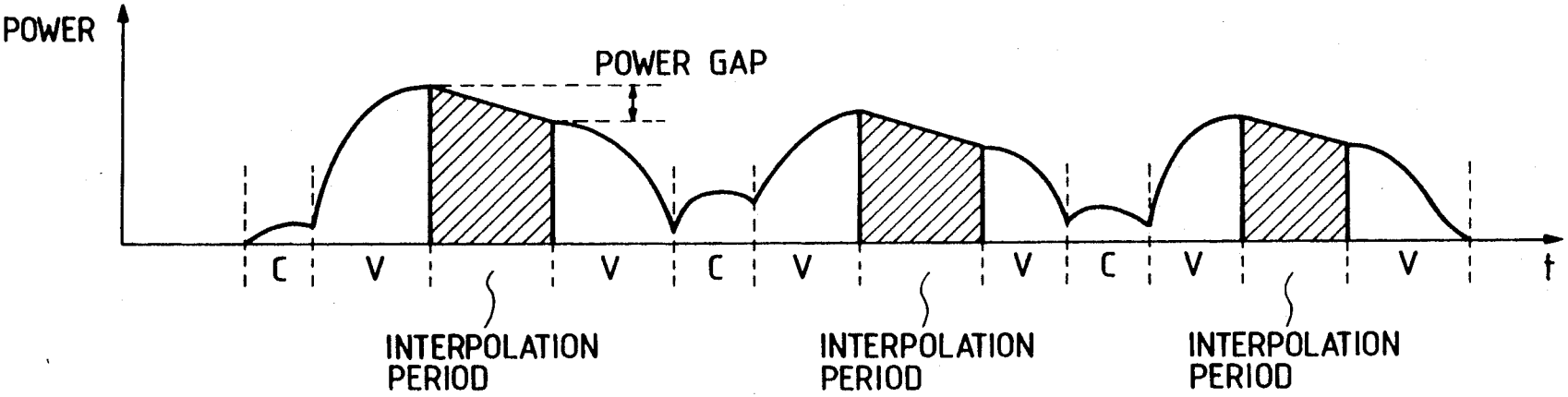
FIG. 2 is a graph showing a power gap in a VCV segment connection.

FIG. 1 is a block diagram for explaining an embodiment for interpolating a vowel gap between speech segment data by normalizing the power of speech segment data when the speech segment data are connected to each other. An arrangement of this embodiment comprises a text input means 1 for inputting words or sentences to be synthesized, a text analyzer 2 for analyzing an input text and decomposing the text into a phoneme series and for analyzing a control code (i.e., a code for controlling accent information and an utterance speed) included in the input text, a parameter reader 3 for reading necessary speech segment parameters from phoneme series information of the text from the text analyzer 2, and a VCV parameter file 4 for storing VCV speech segments and speech power information thereof. The arrangement of this embodiment also includes a pitch generator 5 for generating pitches from control information from the text analyzer 2, a power normalizer 6 for normalizing powers of the speech segments read by the parameter reader 5, a power normalization data memory 7 for storing a power reference value used in the power normalizer 6, a parameter connector 8 for connecting power-normalized speech segment data, a speech synthesizer 9 for forming a speech waveform from the connected parameter series and pitch information, and an output means 10 for outputting the speech waveform.

Figure 3:
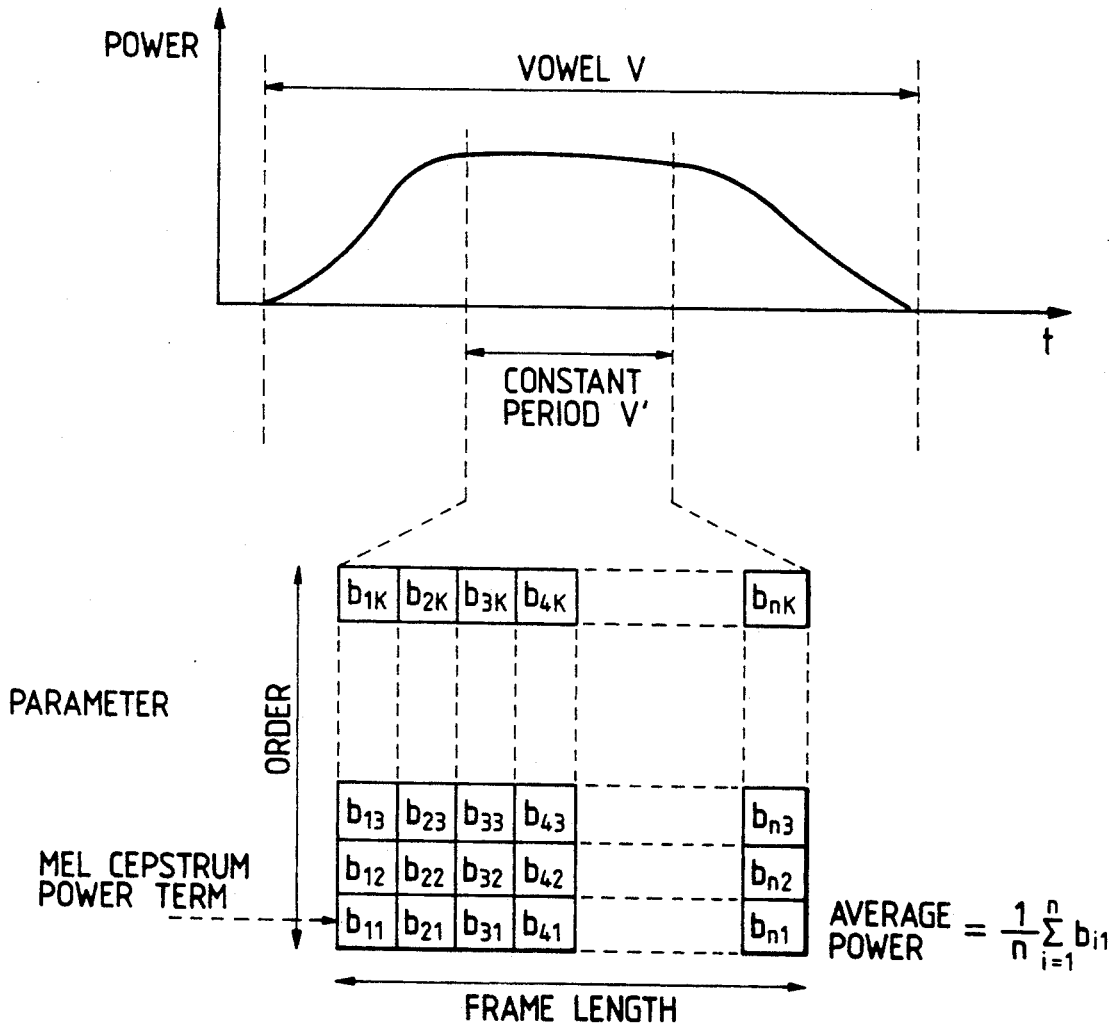
FIG. 3 is a graph showing a method of obtaining an average power value of vowels.

In this embodiment, in order to normalize a power using the average vowel power as a reference when speech segments are to be connected, a standard power value for normalizing the power is obtained in advance and must be stored in the power normalization data memory 7, and a method of obtaining and storing the reference value will be described below. FIG. 3 is a view showing a method of obtaining an average vowel power. A constant period V' of a vowel V is extracted in accordance with a change in its power, and a feature parameter $\{b_{ij}\}$ ($1 \leqq i \leqq n$, $1 \leqq j \leqq k$) is obtained. In this case, k is an analysis order and n is a frame count in the constant period V'. Terms representing pieces of power information are selected from the feature parameters $\{b_{ij}\}$ (i.e., first-order terms in Mel Cepstrum coefficients) and are added and averaged along a time axis (i direction) to obtain the average value of the power terms. The above operations are performed for every vowel (an average power of even a syllabic nasal is obtained if necessary), and the average power of each vowel is obtained and stored in the power normalization data memory 7.

Operations will be described in accordance with a data stream. A text to be analyzed is input from the text input means 1. It is now assumed that a control code for controlling the accent and the utterance speed is inserted in a character such as a Roman character or a kana character. However, when a speech output of a sentence consisting of kanji and kana characters is to be output, a language analyzer is connected to the input of the text input means 1 to convert an input sentence into a sentence consisting of kanji and kana characters.

The text input from the text input means 1 is analyzed by the text analyzer 2 and is decomposed into reading information (i.e., phoneme series information), and information (control information) representing an accent position and a generation speed. The phoneme series information is input to the parameter reader 3 and a designated speech segment parameter is read out from the VCV parameter file 4. The speech segment parameter input output from the parameter reader 3 is power-normalized by the power normalizer 6.

Figure 4A:
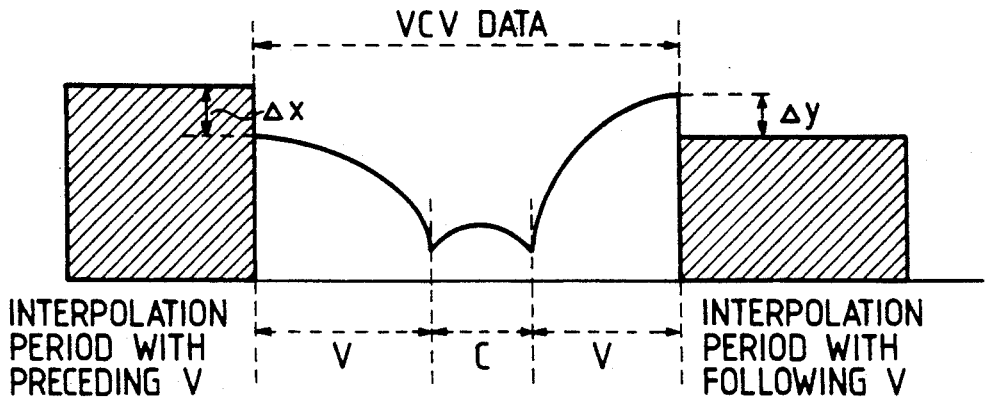
FIGS. 4A, 4B, and 4C are graphs showing a vowel power normalization method in a VCV segment.
Figure 4B:
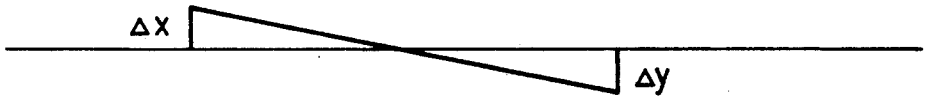
Figure 4C:
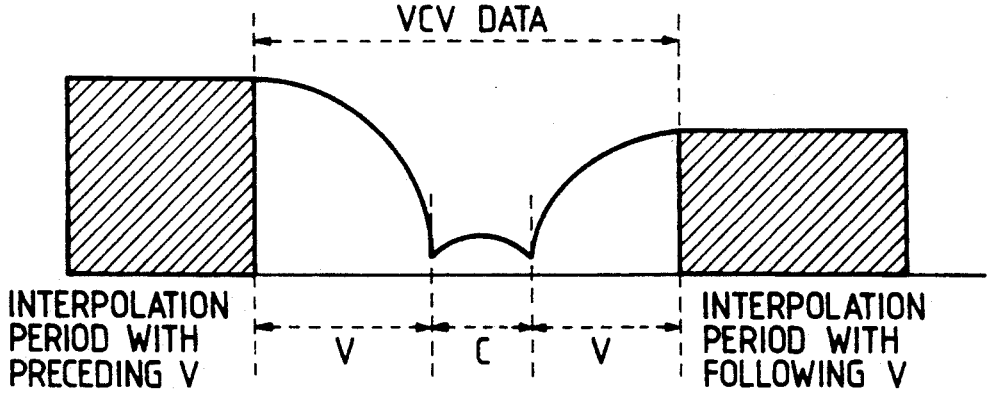

FIGS. 4A and 4B are graphs for explaining a method of normalizing a vowel power in a VCV segment. FIG. 4A shows a change in power in the VCV data extracted from a data base, FIG. 4B shows a power normalization function, and FIG. 4C shows a change in power of the VCV data normalized by using the normalization function shown in FIG. 4B. The VCV data extracted from the data base has variations in its power of the same vowel, depending on generation conditions. As shown in FIG. 4A, at both ends of the VCV data, gaps are formed between the average powers of the vowel stored in the power normalization data memory 7. The gaps ($\Delta x$ and $\Delta y$) at both ends of the VCV data are measured to generate a line for canceling the gaps at both the ends to obtain a normalization function. More specifically, as shown in FIG. 4B, the gaps ($\Delta x$ and $\Delta y$) at both the ends are connected by a line between the VCV data to obtain the power normalization function.

The normalization function generated in FIG. 4B is applied to original data in FIG. 4A, and an adjustment is performed to cancel the power gaps, thereby obtaining the normalized VCV data shown in FIG. 4C. In this case, a parameter (e.g., a Mel Cepstrum parameter) given as a logarithmic value can be adjusted by an addition or subtraction operation. The normalization function shown in FIG. 4B is added to or subtracted from the original data shown in FIG. 4A, thereby simply normalizing the original data. FIGS. 4A to 4C show normalization using a Mel Cepstrum parameter for the sake of simplicity.

In the parameter connector 8, the VCV data power-normalized by the power normalizer 6 is located so that the mora lengths are equidistantly arranged, and the constant period of the vowel is interpolated, thereby generating a parameter series.

The pitch generator 5 generates a pitch series in accordance with the control information from the text analyzer 2. A speech waveform is generated by the synthesizer 9 using this pitch series and the parameter series obtained from the parameter connector 8. The synthesizer 9 is constituted by a digital filter. The generated speech waveform is output from the output means 10.

This embodiment may be controlled by a program in a CPU (Central Processing Unit).

In the above description, one straight line is given for one VCV data period as a normalization function in the power normalizer 6. However, according to this technique, a C (consonant) portion is also influenced by normalization, and its power is changed. Only vowels are normalized by the following method.

In the same manner as in normalization of one VCV data as a whole, the average power of each vowel is obtained and stored in the power normalization data memory 7. Data representing marks at the boundaries between the Vs (vowels) and C (consonant) in VCV data used for connection is also stored in the memory.

Figure 5A:
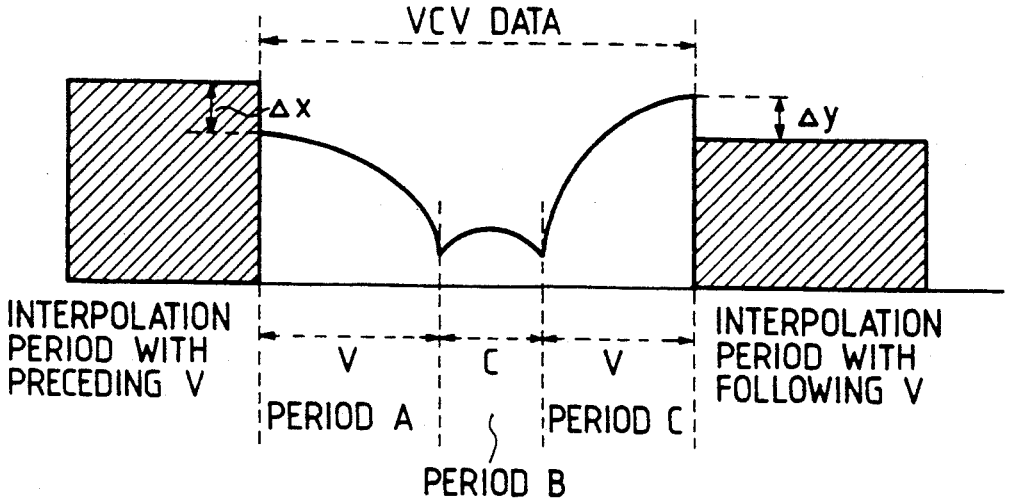
FIGS. 5A, 5B, and 5C are graphs showing another vowel power normalization method in a VCV segment.
Figure 5B:
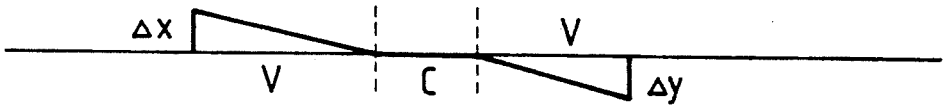
Figure 5C:
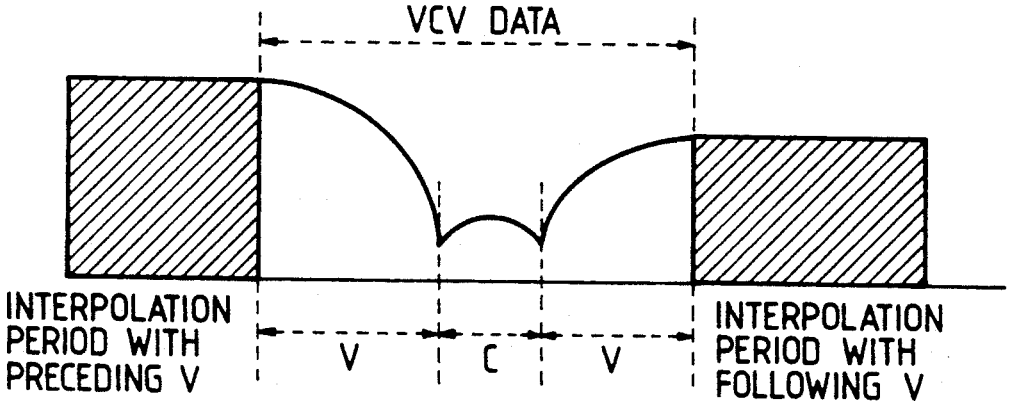

FIGS. 5A, 5B, and 5C are graphs for explaining normalization of only vowels in VCV data. FIG. 5A shows a change in power of the VCV data extracted from a data base, FIG. 5B shows a power normalization function for normalizing the power of a vowel, and FIG. 5C shows a change in the power of the VCV data normalized by the normalization function.

In the same manner as in normalization of the VCV data as a whole, gaps ($\Delta x$ and $\Delta y$) between both ends of VCV data and the average power of each vowel are measured. As for the gap $\Delta x$, in order to cancel the gap in the preceding V of the VCV data, a line obtained by connecting $\Delta x$ and $\Delta x0$ in a period A in FIG. 5A is defined as a normalization function. Similarly, as for $\Delta y$, a line obtained by connecting the gap $\Delta y$ and $\Delta y0$ in a period C in FIG. 5A is define normalization function in order to cancel the gap in the range of the following V of the VCV data. No normalization function is set for the consonant in a period B.

In order to set a power value in practice, the power normalization functions shown in FIG. 5B are applied to the original data in FIG. 5A in the same manner as in normalization of the VCV data as a whole, thereby obtaining the normalized VCV data shown in FIG. 5C. At this time, a parameter (e.g., a Mel Cepstrum parameter) given by a logarithmic value can be adjusted by an addition/subtraction operation. The normalization functions shown in FIG. 5B are subtracted from the original data shown in FIG. 5A to simply obtain normalized data. FIGS. 5A to 5C exemplify a case using a Mel Cepstrum parameter for the sake of simplicity.

As described above, the power normalization functions are obtained to cancel the gaps between the average vowel powers and the VCV data powers, and the VCV data is normalized, thereby obtaining more natural synthesized speech. Generation of power normalization functions is exemplified by the above two cases. However, the following function may be used as a normalization function.

Figure 6:
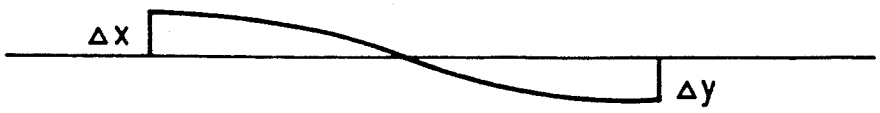
FIG. 6 is a graph showing a normalization method of a VCV segment by using a quadratic curve.

FIG. 6 is a graph showing a method of generating a power normalization function in addition to the above two normalization functions. The normalization function of FIG. 4B is obtained by connecting the gaps ($\Delta x$ and $\Delta y$) by a line. However, in FIG. 6, a quadratic curve which is set to be zero at both ends of VCV data is defined as a power normalization function. The preceding and following interpolation periods of the VCV data are not power-adjusted by the normalization function. When the gradient of the power normalization function is gradually decreased to zero, a change in power upon normalization can be smooth near a boundary between the VCV data and the average vowel power in the interpolation period.

A power normalization method in this case is the same as that described with reference to the above embodiment.

Figure 7:
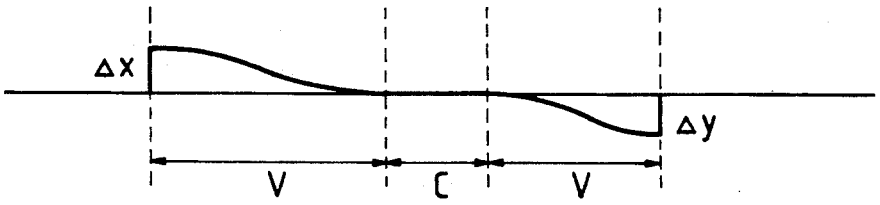
FIG. 7 is a graph showing another normalization method of a VCV segment by using a quadratic curve.

FIG. 7 shows a graph showing still another method of providing a power normalization function different from the above three normalization functions. During the periods A and C of the power normalization function in FIG. 4B, a quadratic curve having zero gradient at their boundaries is defined as a power normalization function Since the preceding and following interpolation periods of the VCV data are not power-adjusted by the normalization functions, when the gradients of the power normalization functions are gradually decreased to zero, a change in power upon normalization can be smooth near the boundaries between the VCV data and the average vowel powers in the interpolation periods. In this case, the change in power near the boundaries of the VCV data can be made smooth.

In this case, the power normalization method is the same as described with reference to the above embodiment.

In the above method, the average vowel power has a predetermined value in units of vowels regardless of connection timings of the VCV data. However, when a word or sentence is to be synthesized, a change in vowel power depending on positions of VCV segments can produce more natural synthesized speech. If a change in power is assumed to be synchronized with a change in pitch, the average vowel power (to be referred to as a reference value of each vowel) can be manipulated in synchronism with the pitch. In this case, a rise or fall ratio (to be referred to as a power characteristic) for the reference value depending on a pitch pattern to be added to synthesized speech is determined, and the reference value is changed in accordance with this ratio, thereby adjusting the power. An arrangement of this technique is shown in FIG. 8.

Figure 8:
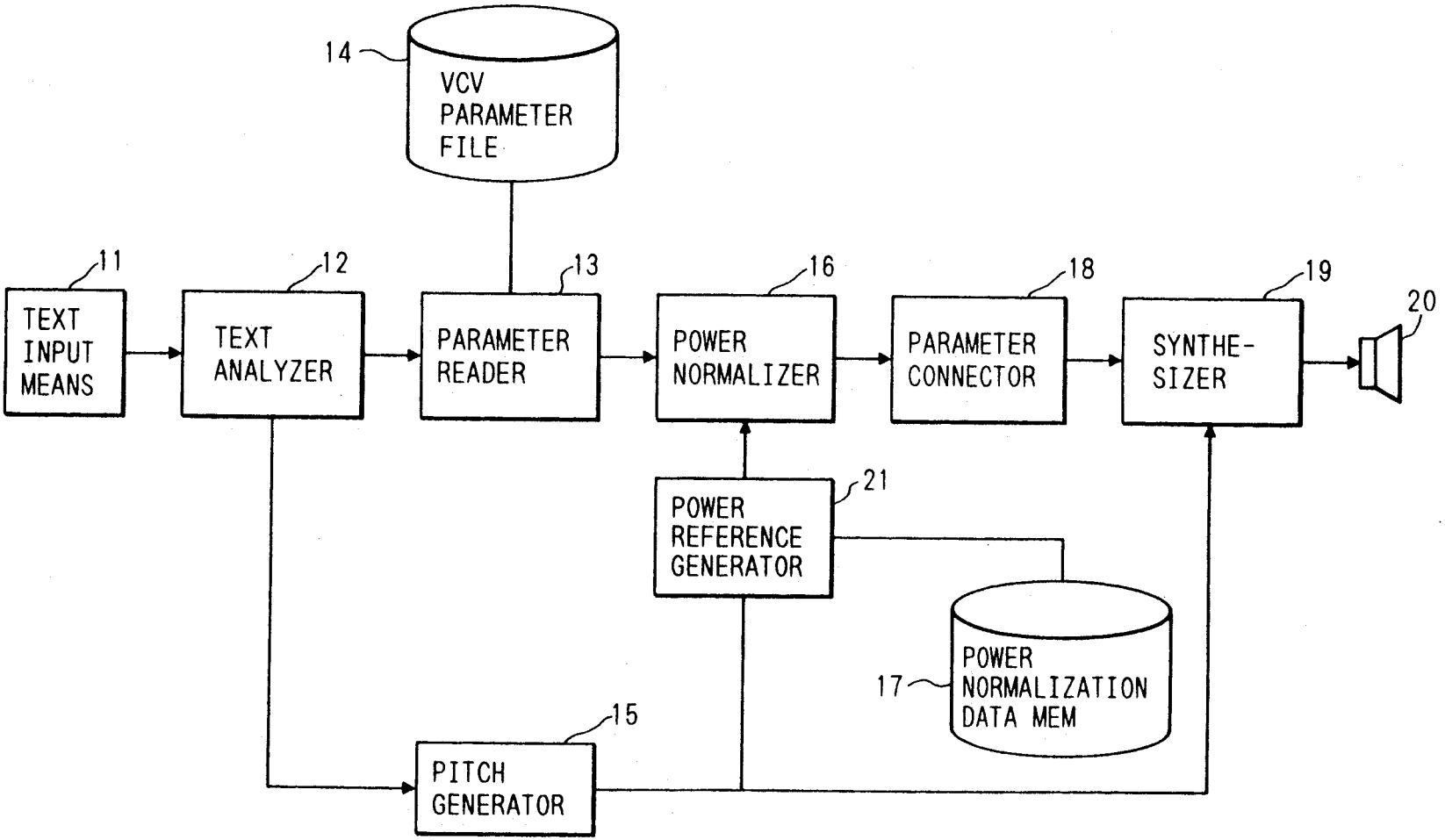
FIG. 8 is a block diagram showing an arrangement for changing a vowel power reference value to perform power normalization.

Circuit components 11 to 20 in FIG. 8 have the same functions as those of the blocks in FIG. 1.

The arrangement of FIG. 8 includes a power reference generator 21 for changing the reference power of the power normalization data memory 17 in accordance with a pitch pattern generated by the pitch generator 15.

The arrangement of FIG. 8 is obtained by adding the power reference generator 21 to the arrangement of the block diagram of FIG. 1, and this circuit component will be described with reference to FIGS. 9A to 9D.

Figures 9A, 9B, 9C, 9D:
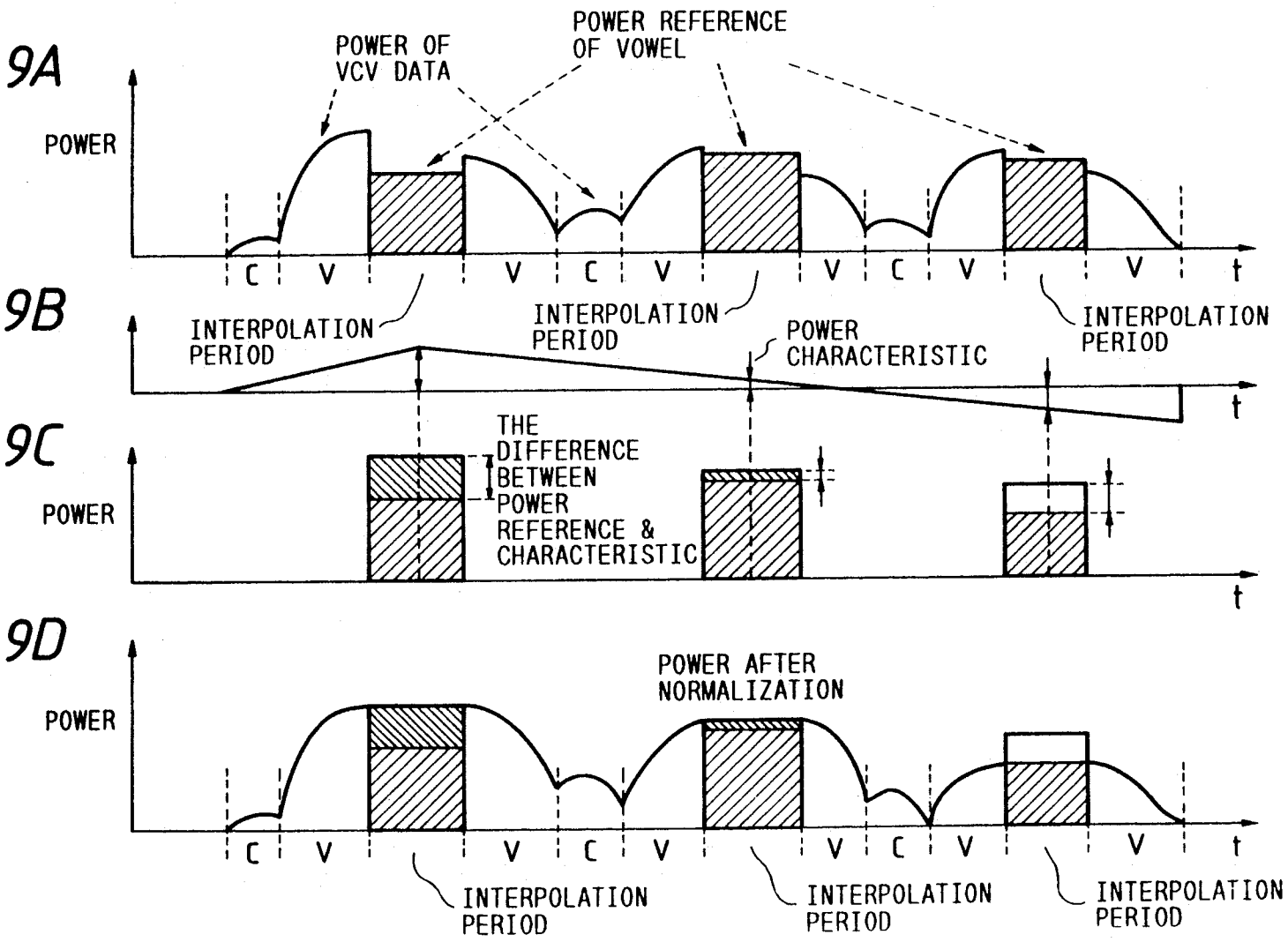
FIGS. 9A to 9D are graphs showing a power normalization method by changing a vowel power reference value.

FIG. 9A shows a relationship between a change in power and a power reference of each vowel when VCV data is plotted along a time axis in accordance with an input phoneme series, FIG. 9B shows a power characteristic obtained in accordance with a pitch pattern, FIG. 9C shows a reference between the power reference and the characteristic, and FIG. 9D shows a power obtained upon normalization of the VCV data.

When a sentence or word is to be uttered, the start of the sentence or word has a higher power, and the power is gradually reduced toward its end. This can be determined by the number of morae representing a syllable count in the sentence or word, and the order of a mora having the highest power in a mora series. An accent position in a word temporarily has a high power. Therefore, it is possible to assume a power characteristic in accordance with a mora count of the word and its accent position. Assume that a power characteristic shown in FIG. 8B is given, and that a vowel reference during an interpolation period of FIG. 9A is corrected in accordance with this power characteristic. When a Mel Cepstrum coefficient is used, its parameter is given as a logarithmic value. As shown in FIG. 9C, the reference is changed by adding the correction value to or subtracting it from the reference. The changed reference is used to normalize the power of the VCV data of FIG. 9A, as shown in FIG. 9D. The normalization method is the same as that described above.

The above normalization method may be controlled by a program in a CPU (Central Processing Unit).

Expansion/Reduction of Speech Segment at Synthesized Speech Utterance Speed

Figure 10:
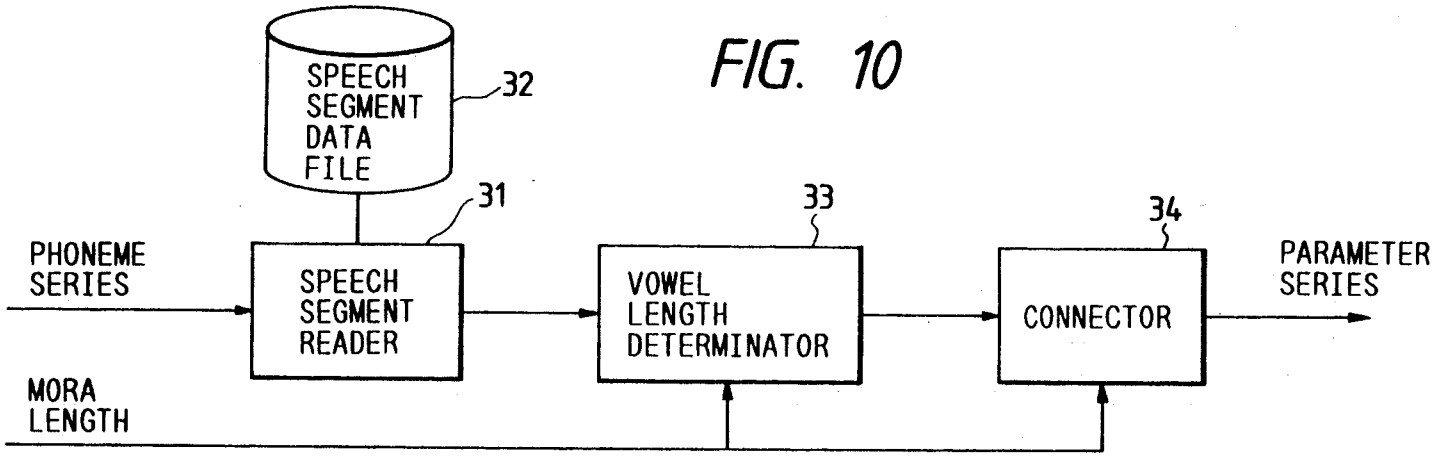
FIG. 10 is a block diagram showing an arrangement for first determining a vowel length when a mora length is to be changed.

FIG. 10 is a block diagram showing an arrangement for expanding/reducing speech segment at a synthesized speech utterance speed and for synthesizing speech. This arrangement includes a speech segment reader 31, a speech segment data file 32, a vowel length determinator 33, and a segment connector 34.

Figure 11:
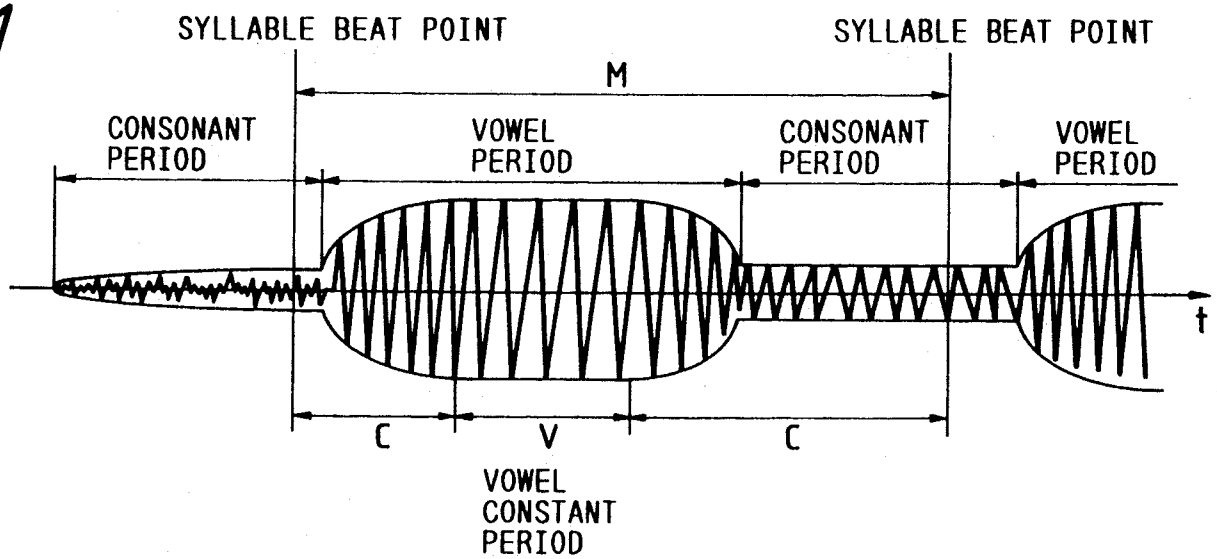
FIG. 11 is a view showing a mora length, a vowel periods, and a consonant period in a speech waveform.

The speech segment reader 31 reads speech segment data from the speech segment data file 32 in accordance with an input phoneme series. Note that the speech segment data is given in the form of a parameter. The vowel length determinator 33 determines the length of a vowel constant period in accordance with mora length information input thereto. A method of determining the length of the vowel constant period will be described with reference to FIG. 11.

VCV data has a vowel constant period length V, and a period length C except for the vowel constant period within one mora. A mora length M has a value changed in accordance with the utterance speed. The period lengths V and C are changed in accordance with a change in mora length M. When the consonant and the vowel are shortened at the same ratio, the utterance speed is high. When a mora length is small, the constant can hardly be heard. The vowel period is minimized as much as possible, and the consonant period is maximized as much as possible. When the utterance speed is low and the mora length is large, an excessively long constant period causes unnatural sounding of the consonant. In this case, the consonant period is kept unchanged, and the vowel period is changed.

Figure 12:
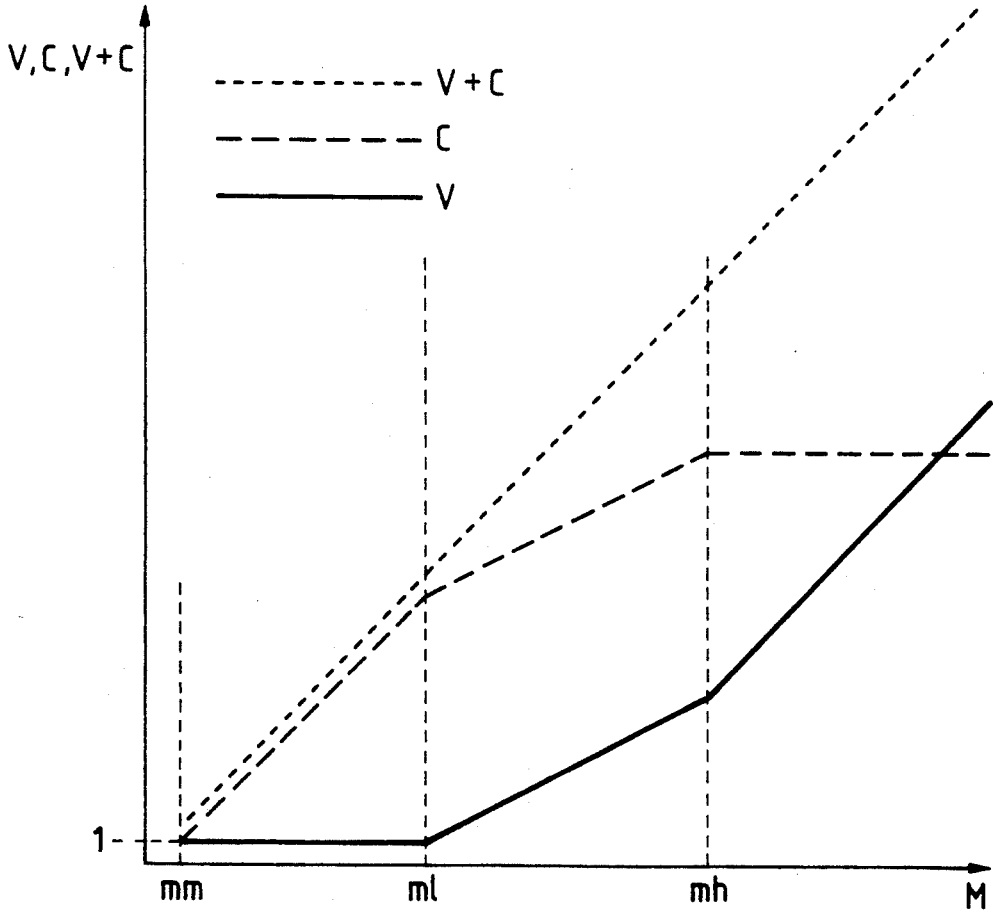
FIG. 12 is a graph showing the relationship between a more length, a vowel period, and a consonant period.

Changes in vowel and consonant lengths in accordance with changes in mora length are shown in FIG. 12. The vowel length is obtained by using a formula representing the characteristic in FIG. 12 to produce speech which can be easily understood. Points ml and mh are characteristic change points and given as fixed points.

Formulas for obtaining V and C by the mora length are designed as follows:

(1) if $M<ml$, then $V=1$ is given, and $(M-1)$ is assigned to C.

(2) if $ml \leqq M \leqq mh$, then

V and C are changed at a given rate upon a change in M.

(3) $mh \leqq M$, then

C is kept unchanged, and $(M-C)$ is assigned to V.

The above formulas are represented by the following equation:

$$V+C=M$$

More specifically, if $mm \leqq M \leqq ml$, then $$V=vm$$

if $ml \leqq M<mh$, then $$V=vm+a(M-m()$$

if $mh \leqq M$, then $$V=vm+a(mh-ml)+(M-mh)$$

if $mm \leqq M<ml$, then $$C=(M-vm)$$

if $ml \leqq M<mh$, then $$C=(ml-vm)+b(M-ml)$$

if $mh \leqq M$, then $$C=(ml-vm)+b(mh-ml)$$

where a is a value satisfying condition $0 \leqq a \leqq 1$ upon a change in V, b is a value satisfying condition $0 \leqq b \leqq 1$ upon a change in C, $$a+b=1,$$

vm is a minimum value of the vowel constant period length V, mm is a minimum value of the mora length M for $vm<mm$, and ml and mh are any values satisfying condition $mm \leqq ml<mh$.

In the graph shown in FIG. 12, the mora length is plotted along the abscissa, and the vowel constant period length V, the period length C except for the vowel constant period, a sum $(V+C)$ (equal to the mora length M) between the vowel constant period length V and the period length C except for the vowel constant period are plotted along the ordinate.

By the above relations, the period length between phonemes is determined by the vowel length determinator 33 in accordance with input mora length information. Speech parameters are connected by the connector 34 in accordance with the determined period length.

Figure 13:
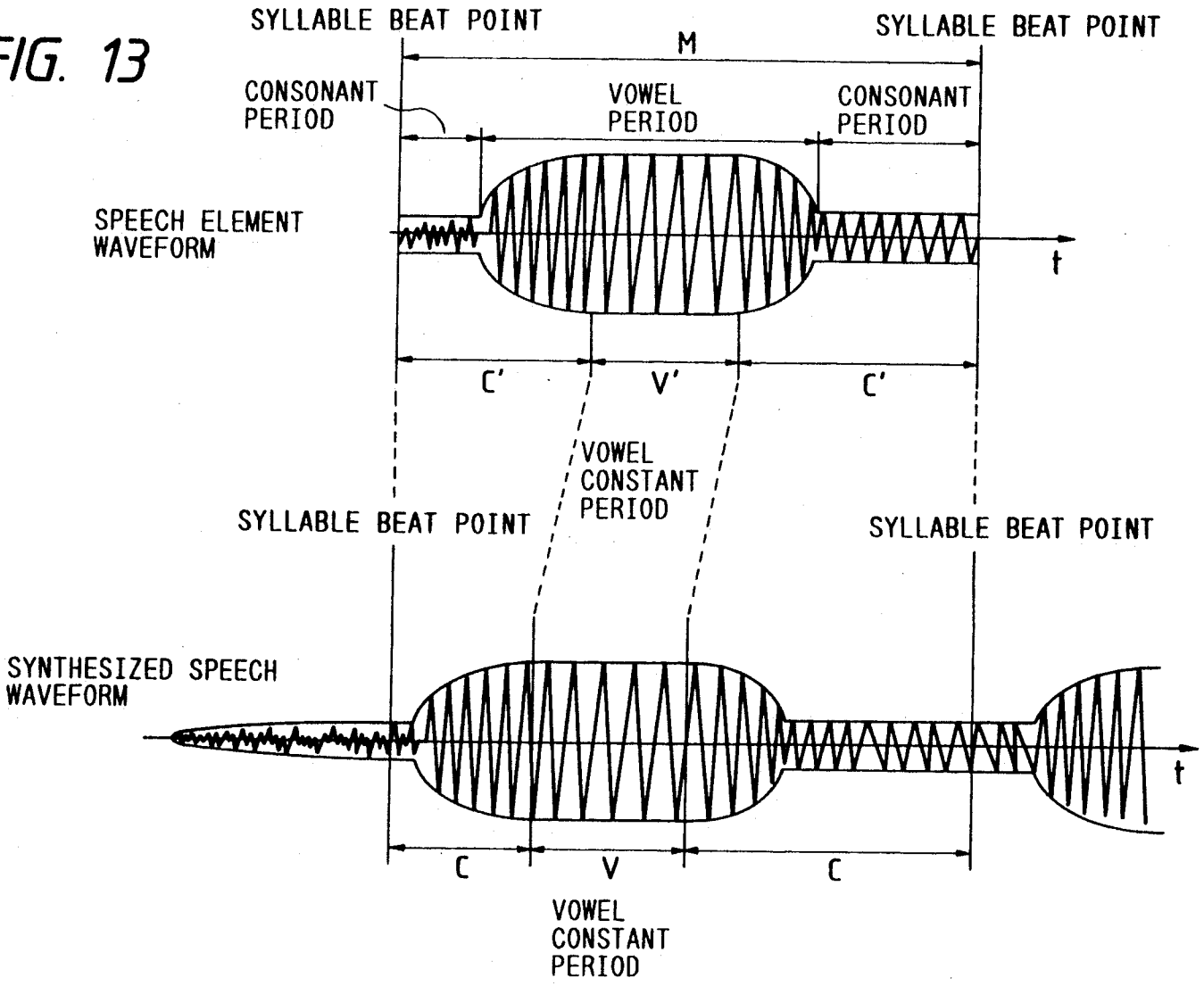
FIG. 13 is a view showing a connecting method by first determining a vowel length when the mora length is to be changed.

A connecting method is shown in FIG. 13. A waveform is exemplified in FIG. 13 for the sake of easy understanding. However, in practice, a connection is performed in the form of parameters.

A vowel constant period length v' of a speech segment is expanded/reduced to coincide with V. An expansion/reduction technique may be a method of expanding/reducing parameter data of the vowel constant period into linear data, or a method of extracting or inserting parameter data of the vowel constant period. A period c' except for the vowel constant period of the speech segment is expanded/reduced to coincide with C. An expansion/reduction method is not limited to a specific one.

The lengths of the speech segment data are adjusted and plotted to generate synthesized speech data. The present invention is not limited to the method described above, but various changes and modifications may be made. In the above method, the mora length M is divided into three parts, i.e., C, V, and C, thereby controlling the period lengths of the phonemes. However, the mora length M need not be divided into three parts, and the number of divisions of the mora length M is not limited to a specific one. Alternatively, in each vowel, a function or function parameter (vm, ml, mh, a, and b) may be changed to generate a function optimal for each vowel, thereby determining a period length of each phoneme.

In the case of FIG. 13, the syllable beat point pitch of the speech segment waveform is equal to that of the synthesized speech. However, since the syllable beat point pitch is changed in accordance with the utterance speed of the synthesized speech, the values v' and V and the values c' and C are also simultaneously changed.

Speech Synthesis Apparatus

Figure 14:
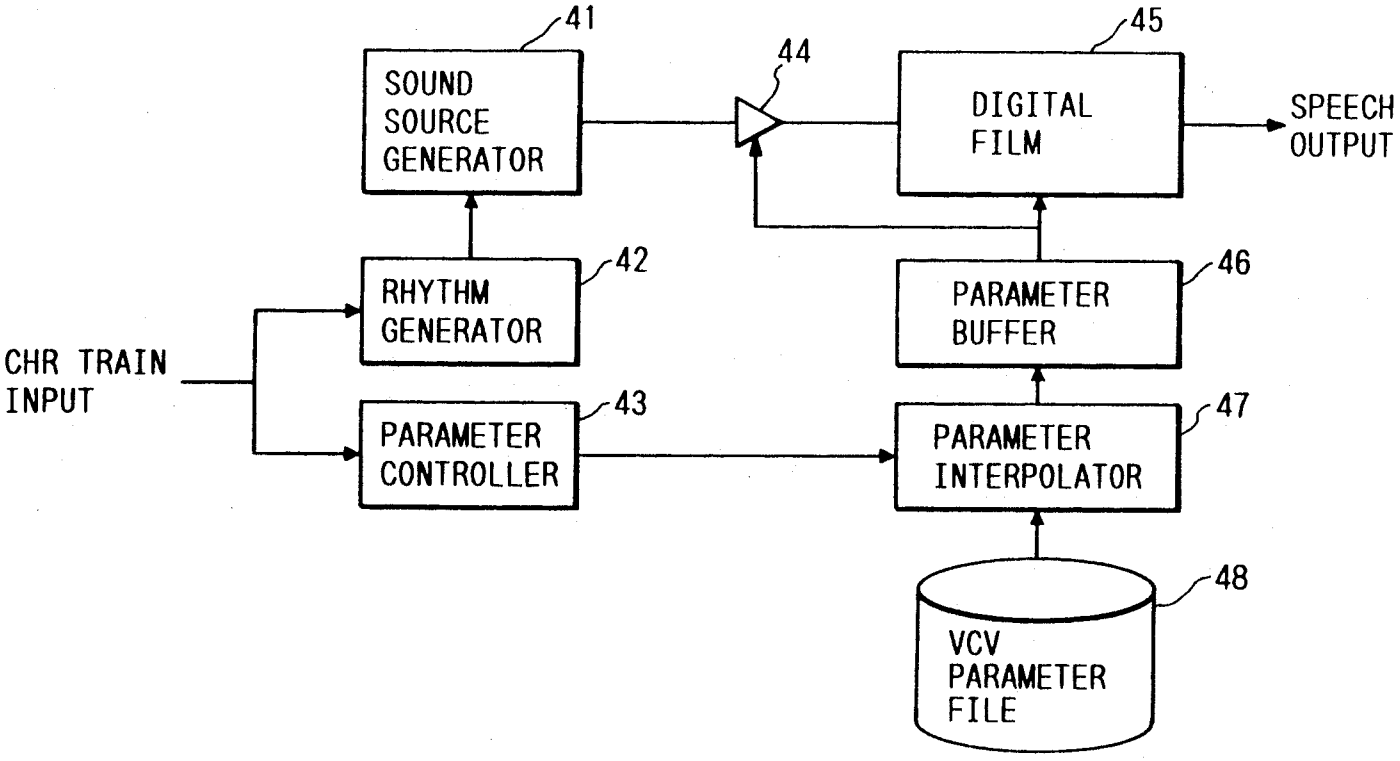
FIG. 14 is a block diagram showing an arrangement for performing speech synthesis at an expansion/reduction rate corresponding to the type of a phoneme.

An important basic arrangement for speech synthesis is shown in FIG. 14.

Figure 15:
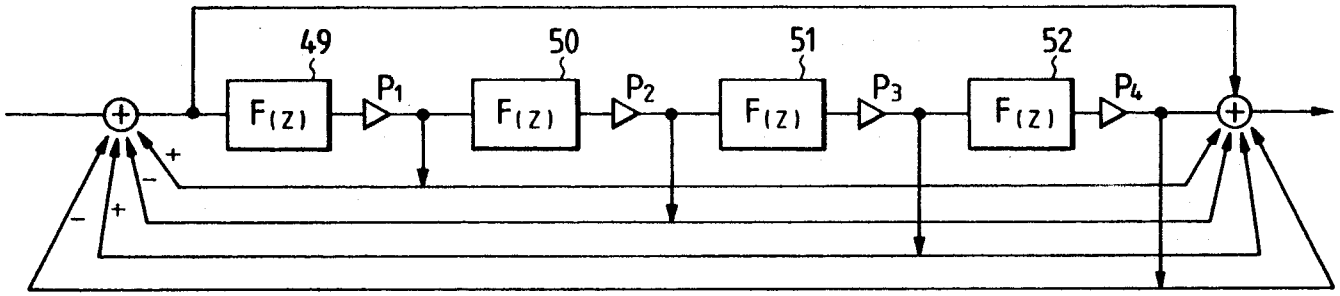
FIG. 15 is a block diagram showing a digital filter 5 shown in FIG. 14.
Figure 16:
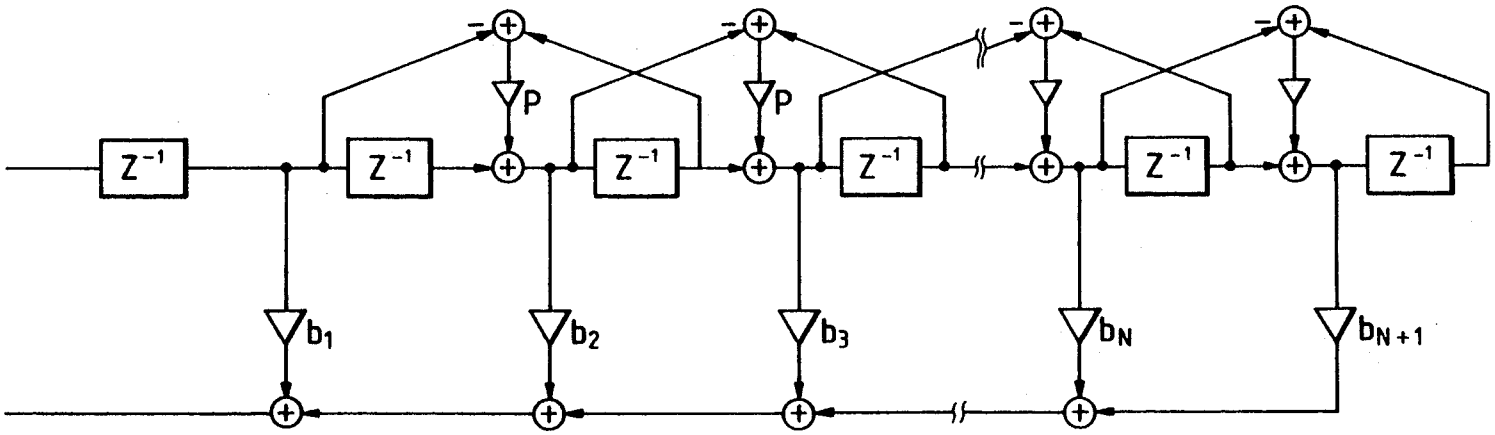
FIG. 16 is a block diagram showing the first embodiment of one of basic filters 9 to 12 in FIG. 15.

A speech synthesis apparatus in FIG. 14 includes a sound source generator 41 for generating noise or an impulse, a rhythm generator 42 for analyzing a rhythm from an input character train and giving the pitch of the sound source generator 41, a parameter controller 43 for determining a VCV parameter and an interpolation operation from the input character train, an adjuster 44 for adjusting an amplitude level, a digital filter 45, a parameter buffer 46 for storing parameters for the digital filter 45, a parameter interpolator 47 for interpolating VCV parameters with the parameter buffer 46, and a VCV parameter file 48 for storing all VCV parameters. FIG. 15 is a block diagram showing an arrangement of the digital filter 45. The digital filter 45 comprises basic filters 49 to 52. FIG. 16 is a block diagram showing an arrangement of one of the basic filters 49 to 52 shown in FIG. 15.

In this embodiment, the basic filter shown in FIG. 16 comprises a discrete filter for performing synthesis using a normalization orthogonal function developed by the following equation:

$$U_n(\omega) = \left(\frac{P - j\omega}{P + j\omega}\right)^n$$

Figure 17:
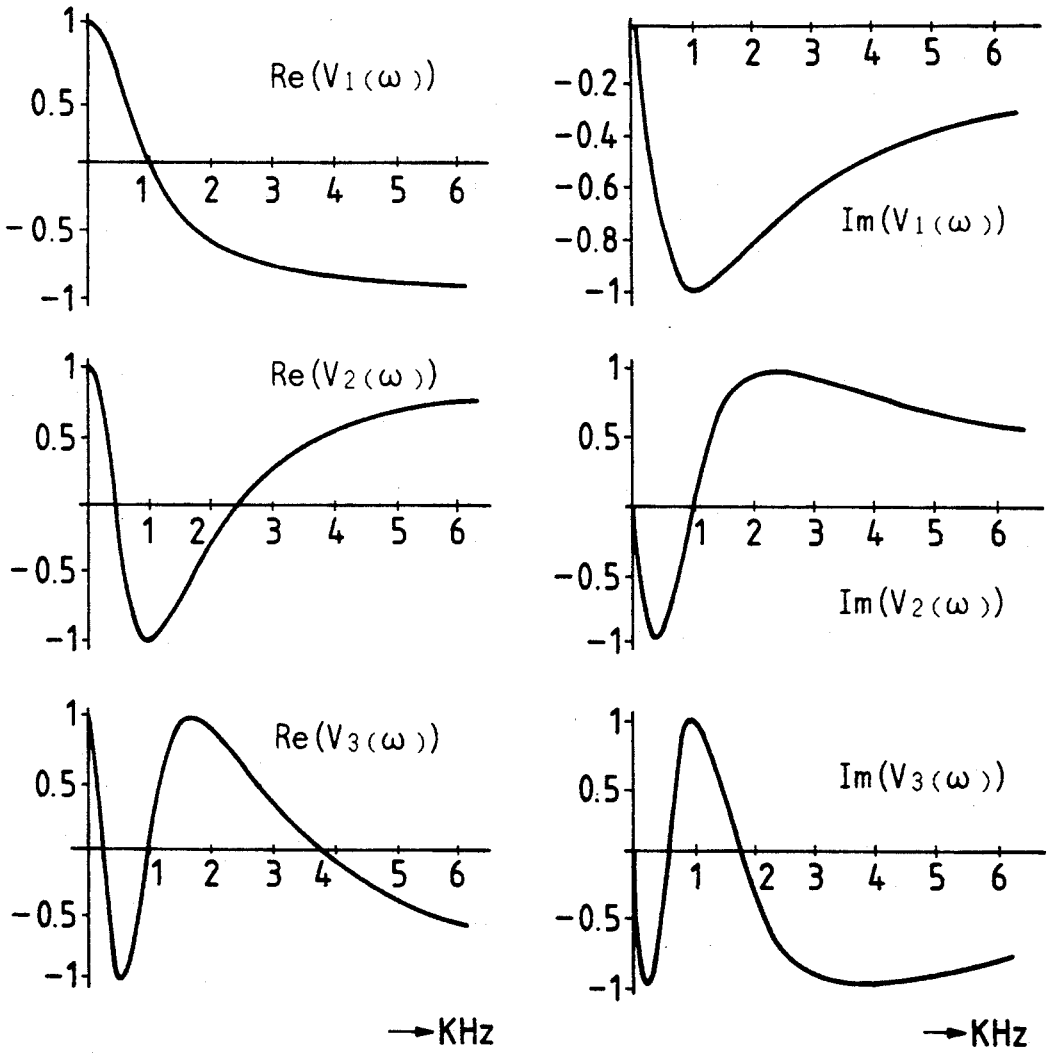
FIG. 17 is a view showing curves obtained by separately plotting real and imaginary parts of a Fourier function.

When this filter is combined with an exponential function approximation filter, the real number of each normalization orthogonal function represents a logarithmic spectral characteristic. FIG. 17 shows curves obtained by separately plotting the real and imaginary parts of the normalization orthogonal function. Judging from FIG. 17, it is apparent that the orthogonal system has a fine characteristic in the low-frequency range and a coarse characteristic in the high-frequency range. A parameter $C_n$ of this synthesizer is obtained as a Fourier-transformed value of a frequency-converted logarithmic spectrum. When frequency conversion is approximated in a Mel unit, it is called a Mel Cepstrum. In this embodiment, frequency conversion need not always be approximated in the Mel unit.

A delay free loop is eliminated from the filter shown in FIG. 16, and a filter coefficient $b_n$ can be derived from the parameter $C_n$ as follows:

$$\alpha = \frac{P - \frac{2}{T}}{P + \frac{2}{T}}$$

Under this condition, $$b_{N+1} = 2\alpha C_N$$

$$b_n = C_n + \alpha(2C_{n-1} - b_{n+1})$$

for $2 \leqq n \leqq N$ $$b_1 = (2C_1 - \alpha b_2)/(1 - \alpha^2)$$

$$b_0 = C_0 - \alpha b_1$$

The processing flow in FIG. 14 will be described in detail below.

A character train is input to the rhythm generator 42, and pitch data P(t) is output from the rhythm generator 42. The sound source generator 41 generates noise in a voiceless period and an impulse in a voiced period. At the same time, the character train is also input to the parameter controller 43, so that the type of VCV parameter and an interpolation operation are determined. The VCV parameters determined by the parameter controller 43 are read out from the VCV parameter file 48 and connected by the parameter interpolator 47 in accordance with the interpolation method determined by the parameter controller 43. The connected parameters are stored in the parameter buffer 46. The parameter interpolator 47 performs interpolation of parameters between the vowels when VCV parameters are to be connected. Since the parameter has a fine characteristic in the low-frequency range and a coarse characteristic in the high-frequency range, and since the logarithmic spectrum is represented by a linear sum of parameters, linear interpolation can be appropriately performed, thus minimizing distortions. The parameter stored in the parameter buffer 46 is divided into a portion containing a nondelay component ($b_0$) and a portion containing delay components ($b_1, b_2, \ldots, b_{n+1}$). The former component is input to the amplitude level adjuster 44 so that an output from the sound source generator 41 is multiplied by $\exp(b_0)$.

Expansion/Reduction of Parameter

Figure 18:
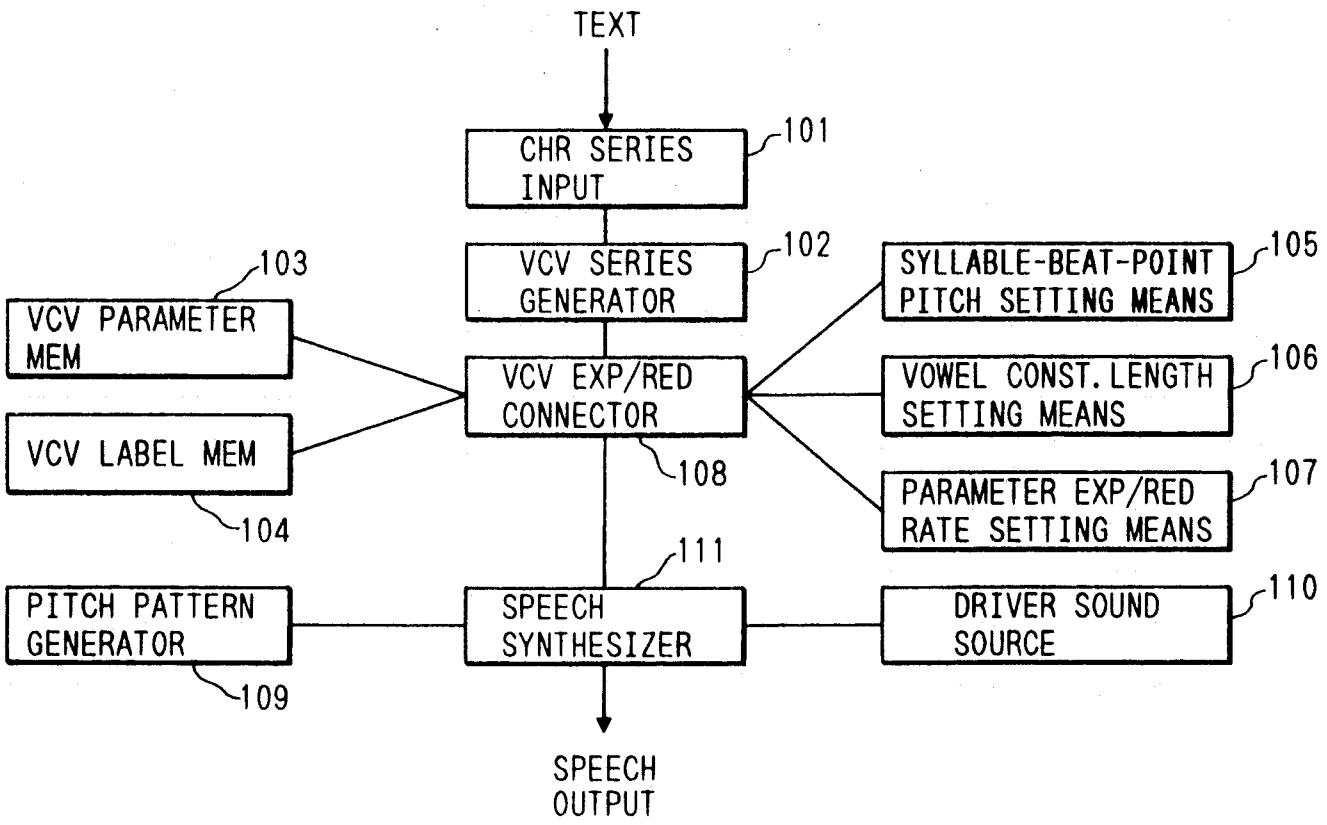
FIG. 18 is a block diagram showing an arrangement for connecting speech segments.

FIG. 18 is a block diagram showing an arrangement for practicing a method of changing an expansion/reduction ratio of speech segments in correspondence with types of speech segments upon a change in utterance speed of the synthesized speech when speech segments are to be connected. This arrangement includes a character series input 101 for receiving a character series. For example, when speech to be synthesized is /on sei/ (which means speech), a character train "On-SEI" is input.

A VCV series generator 102 converts the character train input from the character series input 101 into a VCV series, e.g., "QO, On, nSE, EI, IQ".

A VCV parameter memory 103 stores V (vowel) and CV parameters as VCV parameter segment data or word start or end data corresponding to each VCV of the VCV series generated by the VCV series generator 102.

A VCV label memory 104 stores acoustic boundary discrimination labels (e.g., a vowel start, a voiced period, a voiceless period, and a syllable beat point of each VCV parameter segment stored in the VCV parameter memory 103) together with their position data.

A syllable beat point pitch setting means 105 sets a syllable beat point pitch in accordance with the utterance speed of synthesized speech. A vowel constant length setting means 106 sets the length of a constant period of a vowel associated with connection of VCV parameters in accordance with the syllable beat point pitch set by the syllable beat point pitch setting means 105 and the type of vowel.

A parameter expansion/reduction rate setting means 107 sets an expansion/reduction rate for expanding/reducing VCV parameters stored in the VCV parameter memory 103 in accordance with the types of labels stored in the VCV label memory 104 in such a manner that a larger expansion/reduction rate is given to a vowel, /S/, and /F/, the lengths of which tend to be changed in accordance with a change in utterance speed, and a smaller expansion/reduction rate is given to an explosive consonant such as /P/ and /T/.

A VCV EXP/RED connector 108 reads out from the VCV parameter memory 103 parameters corresponding to the VCV series generated by the VCV series generator 102, and reads out the corresponding labels from the VCV label memory 104. An expansion/reduction rate is assigned to the parameters by the parameter EXP/RED rate setting means 107, and the lengths of the vowels associated with the connection are set by the vowel consonant length setting means 106. The parameters are expanded/reduced and connected to coincide with a syllable beat point pitch set by the syllable beat point pitch setting means 105 in accordance with a method to be described later with reference to FIG. 19.

A pitch pattern generator 109 generates a pitch pattern in accordance with accent information for the character train input by the character series input 101.

A driver sound source 110 generates a sound source signal such as an impulse train.

A speech synthesizer 111 sequentially synthesizes the VCV parameters output from the VCV EXP/RED connector 108, the pitch patterns output from the pitch pattern generator 109, and the driver sound sources output from the driver sound source 110 in accordance with predetermined rules and outputs synthesize speech.

Figure 19:
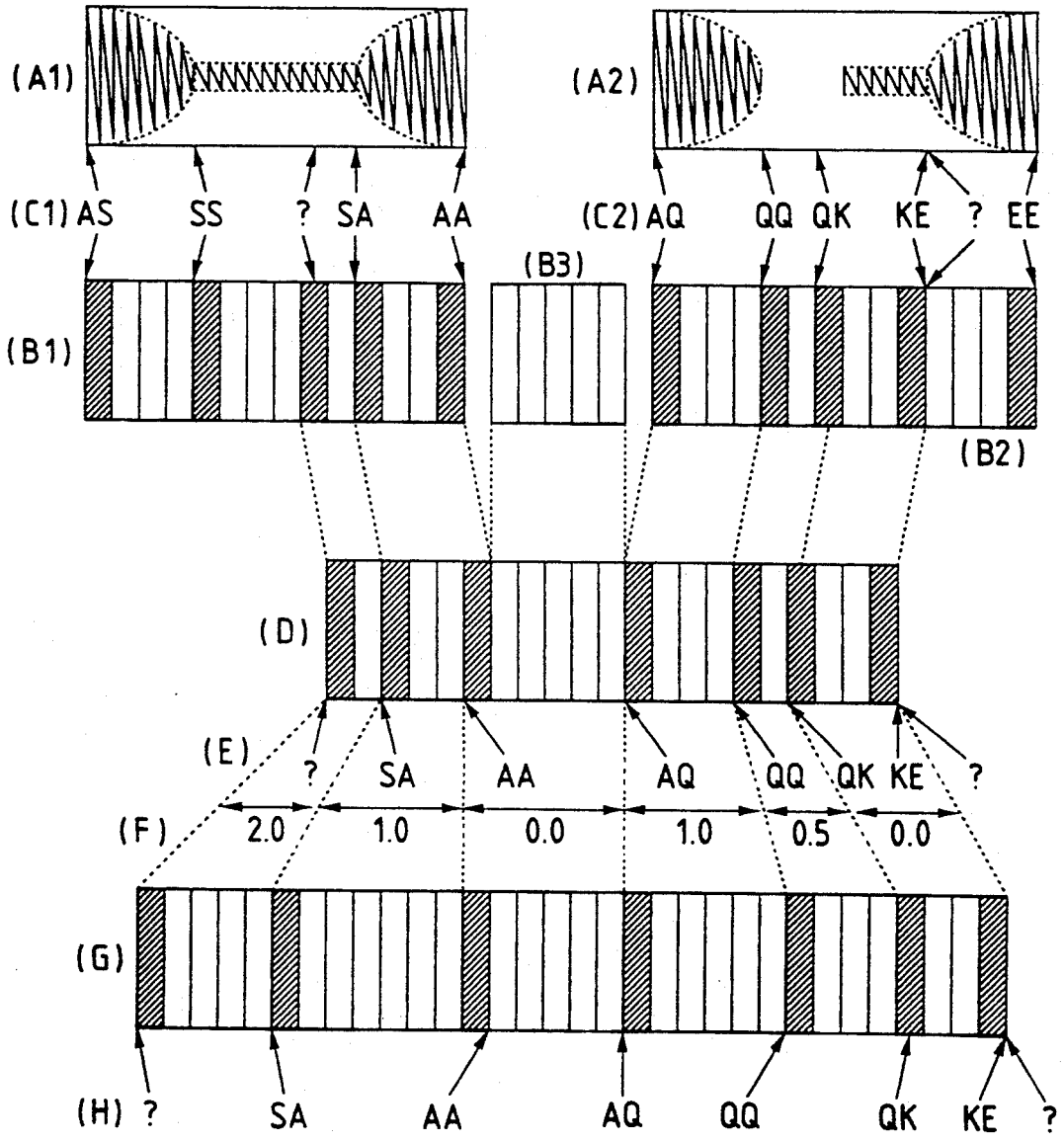
FIG. 19 is a view showing an expansion/reduction connection of speech segments.

FIG. 19 is an operation for expanding/reducing and connecting VCV parameters as speech segments.

(A1) shows part of an utterance of "ASA" (which means morning) in a speech waveform file prior to extraction of the VCC segment, (A2) shows part of an utterance of "ASA" in the speech waveform file prior to extraction of the VCV segment.

(B1) shows a conversion result of waveform information shown in (A1) into parameters. (B2) shows a conversion result of the waveform information of (A2) into parameters. These parameters are stored in the VCV parameter memory 103 in FIG. 14. (B3) shows an interpolation result of spectral parameter data interpolated between the parameters. The spectral parameter data has a length set by a syllable beat point pitch and types of vowels associated with the connection.

(C1) shows an acoustic parameter boundary position represented by label information corresponding to (A1) and (B1). (C2) shows an acoustic parameter boundary position represented by label information corresponding to (A2) and (B2). These pieces of label information are stored in the VCV label memory 104 in FIG. 14. Note that a label "?" corresponds to a syllable bet point.

(D) shows parameters connected after pieces of parameter information corresponding to a portion from the syllable beat point of (C1) to the syllable beat point of (C2) are extracted from (B1), (B3), and (B2).

(E) shows label information corresponding to (D).

(F) shows an expansion/reduction rate set by the types of adjacent labels and represents a relative measure used when the parameters are expanded or reduced in accordance with the syllable beat point pitch of the synthesized speech.

(G) shows parameters expanded/reduced in accordance with the syllable beat point pitch. These parameters are sequentially generated and connected in accordance with the VCV series of speech to be synthesized.

(H) shows label information corresponding to (G). These pieces of label information are sequentially generated and connected in accordance with the VCV series of the speech to be synthesized.

Figure 20:
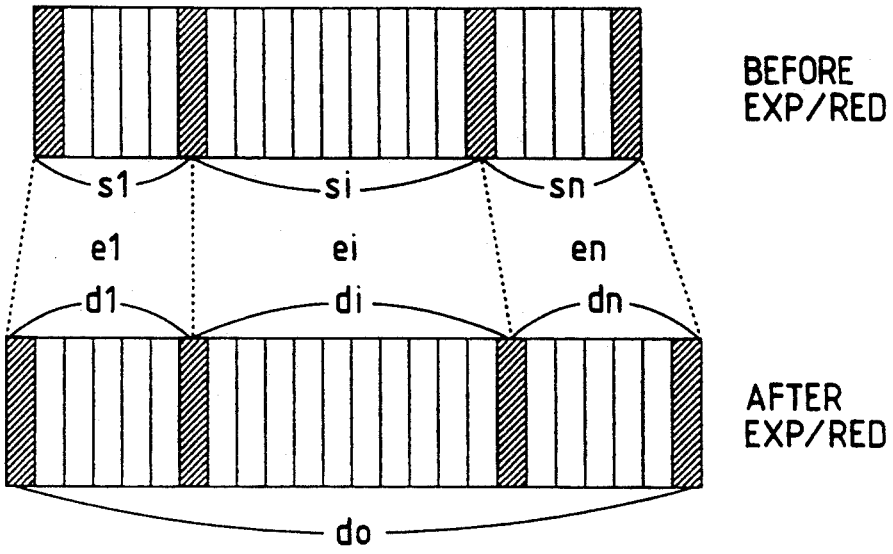
FIG. 20 is a view for explaining an expansion/reduction of parameters.

FIG. 20 shows parameters before and after they are expanded/reduced so as to explain an expansion/reduction operation of the parameter. In this case, the corresponding labels, the expansion/reduction rate of the parameters between the labels, and the length of the parameter after it is expanded/reduced are predetermined. More specifically, the label count is (n+1), a hatched portion in FIG. 20 represents a labeled frame, si ($1 \leqq i \leqq n$) is a pitch between labels before expansion/reduction, ei ($1 \leqq i \leqq n$) is an expansion/reduction rate, di ($1 \leqq i \leqq n$) is a pitch between labels after expansion/reduction, and d0 is the length of a parameter after expansion/reduction.

A pitch di which satisfies the following relation is obtained:

$$\frac{d1 - s1}{s1} : \ldots : \frac{di - si}{si} : \ldots : \frac{dn - sn}{sn} = e1 : \ldots : ei : \ldots : en$$

$$d1 + \ldots + di + \ldots + dn = d0$$

Parameters corresponding to si ($1 \leqq i \leqq n$) are expanded/reduced to the lengths of di and are sequentially connected.

Figure 21:
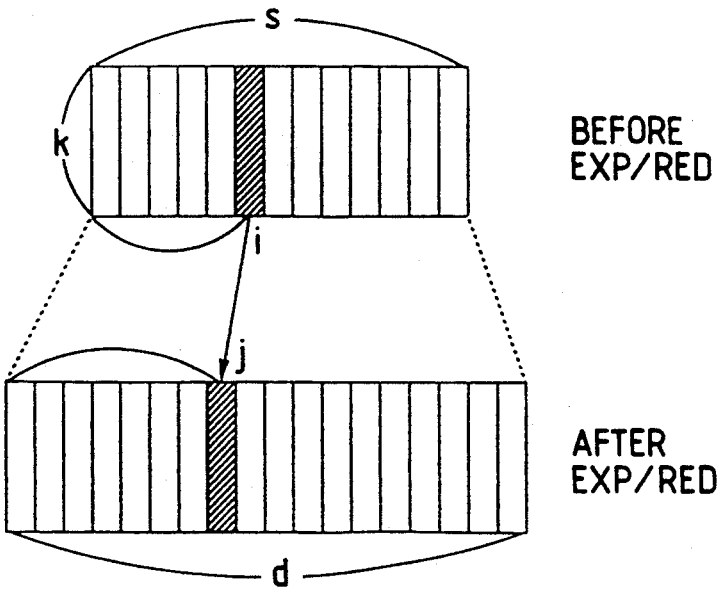
FIG. 21 is a view for further explaining parameter expansion/reduction operations.

FIG. 21 is a view for further explaining a parameter expansion/reduction operation and shows a parameter before and after expansion/reduction. In this case, the lengths of the parameters before and after expansion/reduction are predetermined. More specifically, k is the order of each parameter, s is the length of the parameter before expansion/reduction, and d is the length of the parameter after expansion/reduction.

The jth ($1 \leqq j \leqq d$) frame of the parameter after expansion/reduction is obtained by the following sequence.

A value x defined by the following equation is calculated:

$$j/d = x/s$$

If the value x is an integer, the xth frame before expansion/reduction is inserted in the jth frame position after expansion/reduction. Otherwise, a maximum integer which does not exceed x is defined as i, and the result obtained by weighting and averaging the ith frame before expansion/reduction and the (i+1)th frame before expansion/reduction to the (x−1) vs. (1−x+i) is inserted into the jth frame position after expansion/reduction.

The above operation is performed for all the values j, and the parameter after expansion/reduction can be obtained.

Figure 22:
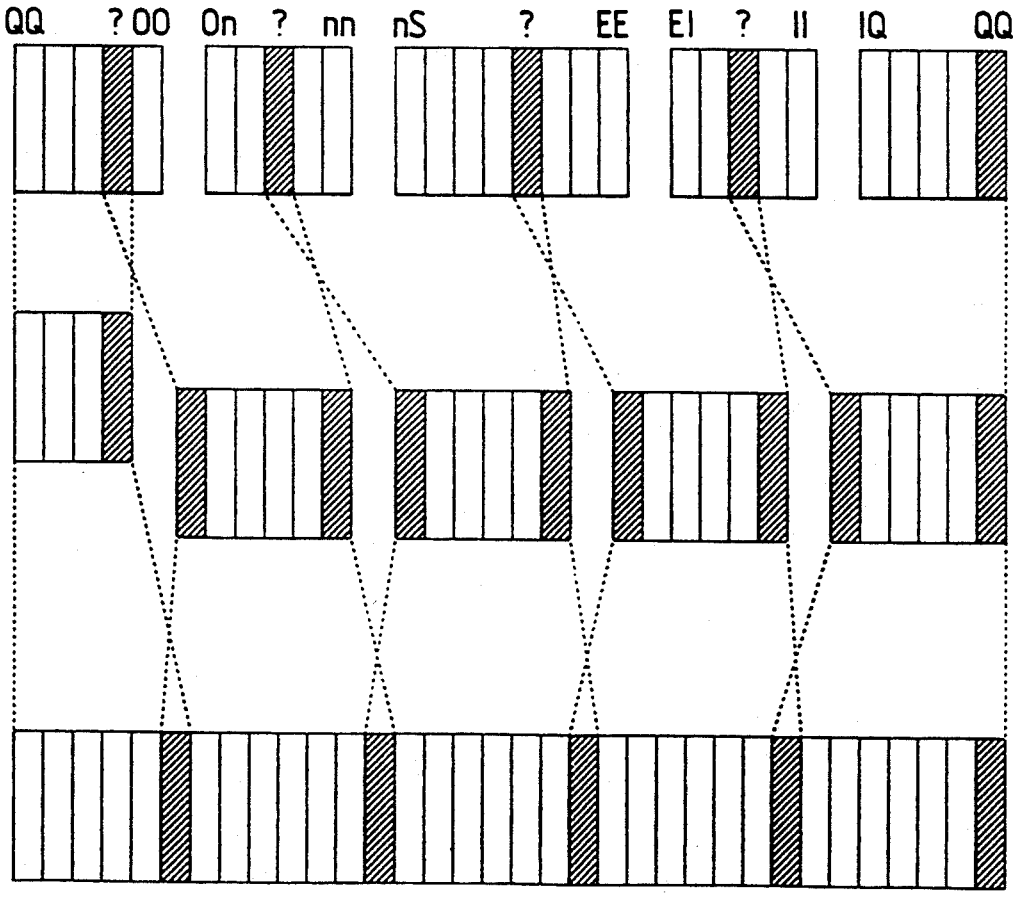
FIG. 22 is a view for explaining operations for connecting parameter information and label information.

FIG. 22 is a view for explaining an operation for sequentially generating and connecting parameter information and label information in accordance with the VCV series of the speech to be synthesized. For example, speech "OnSEI" (which means speech) is to be synthesized.

The speech "OnSEI" is segmented into five VCV phoneme series /QO/, /On/, /nSE/, /EI/, and /IQ/ where Q represents silence.

The parameter information and the label information of the first phoneme series /QO/ are read out, and the pieces of information up to the first syllable beat point are stored in an output buffer.

In the processing described with reference to FIGS. 15, 16, and 17, four pieces of parameter information and four pieces of label information are added and connected to the stored pieces of information in the output buffer. Note that connections are performed so that the frames corresponding to the syllable beat points (label "?") are superposed on each other.

The above operations have been described with reference to speech synthesis by a Fourier circuit network using VCV data as speech segments. Another method for performing speech synthesis by an exponential function filter using VCV data as speech segments will be described below.

An overall arrangement for performing speech synthesis using the exponential function filter, and an arrangement of a digital filter 45 are the same as those in the Fourier circuit network. These arrangements have been described with reference to FIGS. 1 and 15, and a detailed description thereof will be omitted.

Figure 23:
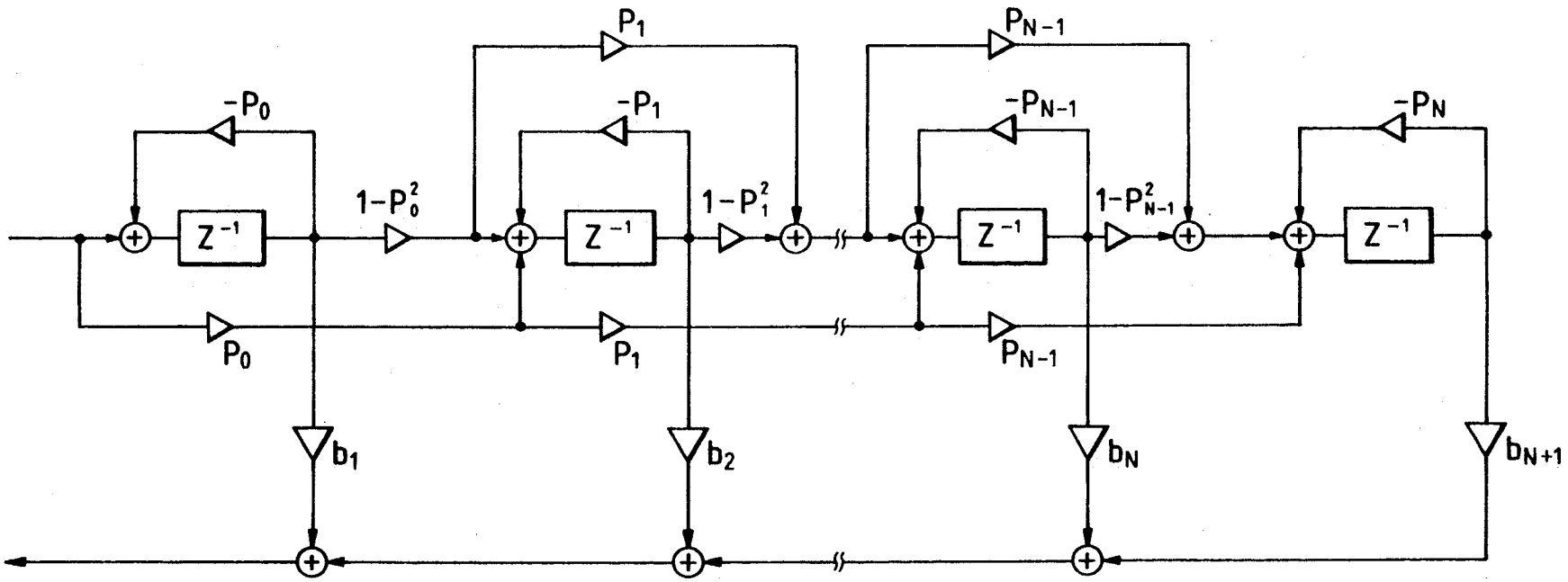
FIG. 23 is a block diagram showing the second embodiment of the basic filters 9 to 12 in FIG. 15.
Figure 24:
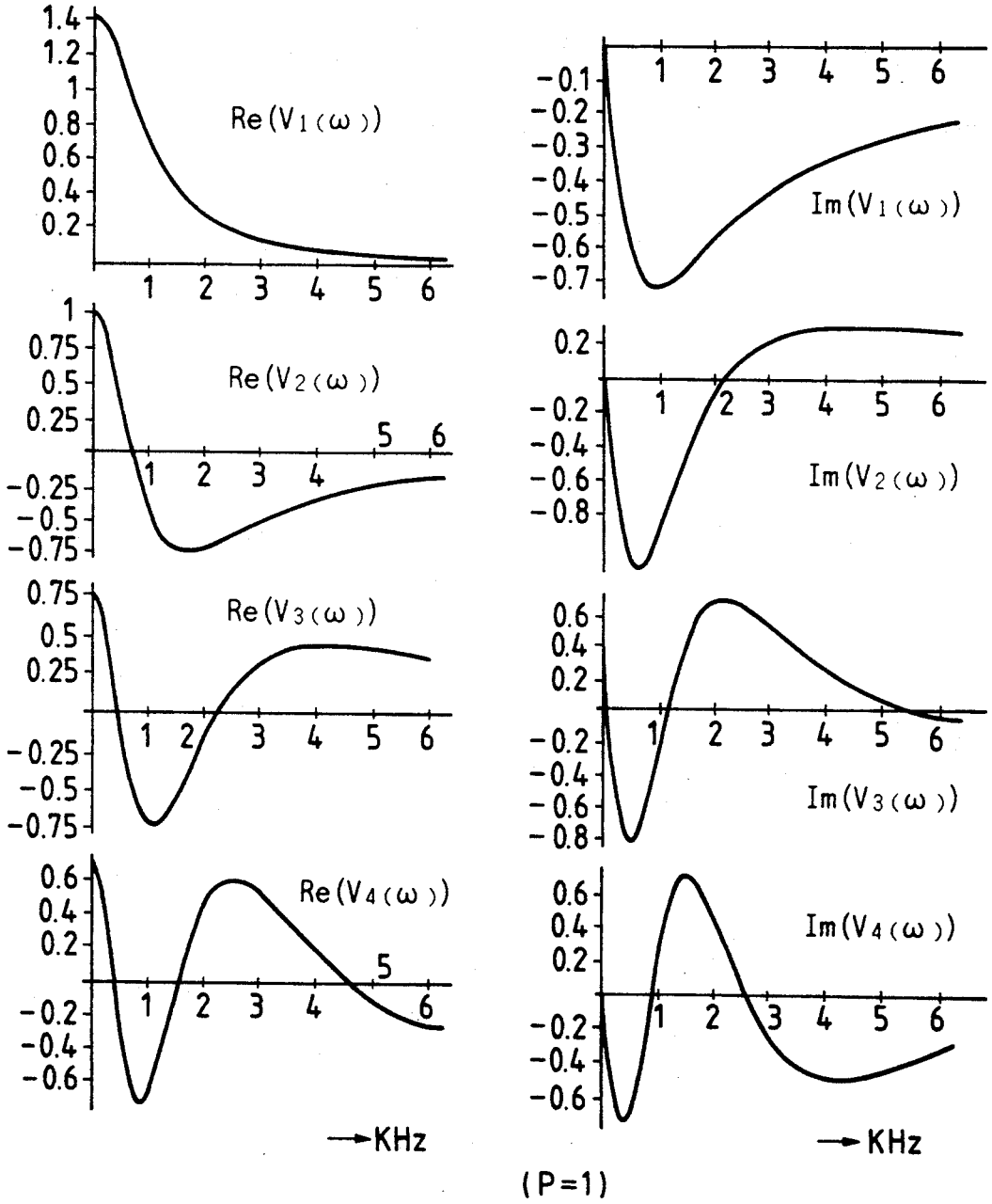
FIG. 24 is a view showing curves obtained by separately plotting real and imaginary parts of a normalization orthogonal function.

FIG. 23 shows an arrangement of one of basic filters 49 to 52 shown in FIG. 15. FIG. 24 shows curves obtained by separately plotting the real and imaginary parts of a normalization orthogonal function.

In this embodiment, the normalization orthogonal function is developed as follows:

$$U_1(\omega) = \sqrt{2P}\ \frac{1}{P + j\omega}$$

$$U_2(\omega) = \sqrt{4P}\ \frac{P - j\omega}{P + j\omega} \cdot \frac{1}{2P + j\omega}$$

$$U_3(\omega) = \sqrt{6P}\ \frac{P - j\omega}{P + j\omega} \cdot \frac{2P - j\omega}{2P + j\omega} \cdot \frac{1}{3P + j\omega}$$

The above function is realized by a discrete filter using bilinear conversion as the basic filter shown in FIG. 23. Judging from the characteristic curves in FIG. 24, the orthogonal system has a fine characteristic in the low-frequency range and a coarse characteristic in the high-frequency range.

A delay free loop is eliminated from this filter, and a filter coefficient $b_n$ can be derived from $C_n$ as follows:

$$b_{N+1} = 2(1 - P_N)K_N - C_N$$

$$b_n = (1 - P_{n-1})\left\{\frac{P_n(1 + P_{n-1})}{1 + P_n}\left(\frac{b_{n+1}}{1 - P_n} + 2K_nC_n\right) + 2K_{n-1}C_{n-1}\right\}$$

for $2 \leqq n \leqq N$ $$b_1 = (1 - P_0)\left\{\frac{P_1(1 + P_0)}{1 + P_1}\left(\frac{b_2}{1 - P_1} + 2K_1C_1\right) + K_0C_0\right\}$$

$$b_0 = K_0C_0 + P_0\left(\frac{b_1}{1 - P_0^2} - \frac{K_0C_0}{1 + P_0}\right)$$

where $$Pn = \frac{np - \frac{2}{T}}{np + \frac{2}{T}}$$

where T is the sample period.

$$Kn = \frac{\sqrt{2np}}{np - \frac{2}{T}}$$

When speech synthesis is to be performed using this exponential function filter, the operations in FIG. 14 and a method of connecting the speech segments are the same as those in the Fourier circuit network, and a detailed description thereof will be omitted.

In the above description, development of the system function is exemplified by the normalization orthogonal systems of the Fourier function and the exponential function. However, any function except for the Fourier or exponential function may be used if the function is a normalization orthogonal function which has a larger volume of information in the low-frequency spectrum.

Voiceless Vowel

Figure 25D:
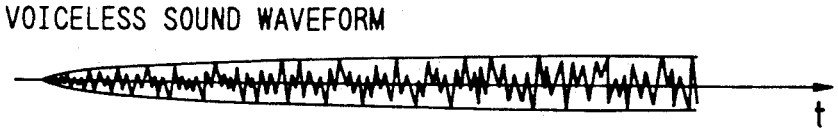
FIG. 25D is a view showing a voiceless sound waveform.
Figure 25E:
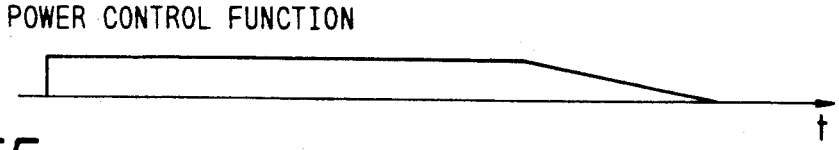
FIG. 25E is a view showing a power control function.
Figure 25F:
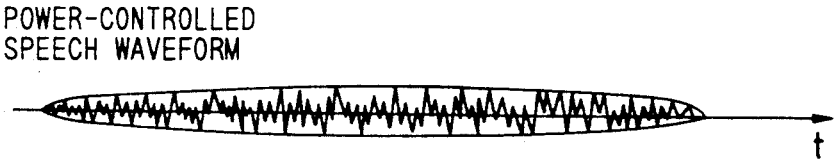
FIG. 25F is a view showing a power-controlled speech waveform.

FIGS. 25A to 25F are views showing a case wherein a voiceless vowel is synthesized as natural speech. FIG. 25A shows speech segment data including a voiceless speech period, FIG. 25B shows a parameter series of a speech segment, FIG. 25C shows a parameter series obtained by substituting a parameter of a voiceless portion of the vowel with a parameter series of the immediately preceding consonant, FIG. 25D shows the resultant voiceless speech segment data, FIG. 25E shows a power control function of the voiceless speech segment data, and FIG. 25F shows a power-controlled voiceless speech waveform. A method of producing a voiceless vowel will be described with reference to the accompanying drawings.

Conditions for producing a voiceless vowel are given as follows:

(1) Voiceless vowels are limited to /i/ and /u/.

(2) A consonant immediately preceding a voiceless vowel is one of silent fricative sounds /s/, /h/, /c/, and /f/, and explosive sounds /p/, /t/, and /k/.

(3) When a consonant follows a voiceless vowel, the consonant is one of explosive sounds /p/, /t/, and /k/.

When the above three conditions are satisfied, a voiceless vowel is produced. However, when a vowel is present at the end of a word, a voiceless vowel is produced when conditions (1) and (2) are satisfied.

When a voiceless vowel is determined to be produced in accordance with the above conditions, speech segment data including voiceless vowel (in practice, a feature parameter series (FIG. 25B) obtained by analyzing speech) is extracted from the data base. At this time, the speech segment data is labeled with acoustic boundary information, as shown in FIG. 25A. Data representing a period from the start of vowel to the end of vowel is changed to data of consonant constant period C from the label information. As a method for this, a parameter of the consonant constant period C is linearly expanded to the end of the vowel to insert a consonant parameter in the period V, as shown in FIG. 25C. A sound source for the period V is determined to select a noise sound source.

If power control is required to prevent formation of power gaps upon connection of the speech segments and to prevent the production of a strange sound, a power control characteristic correction function having a zero value near the end of silence is set and applied to the power term of the parameter, thereby performing power control, as shown in FIG. 25D. When the coefficient is a Mel Cepstrum coefficient, its parameter is represented by a logarithmic value. The power characteristic correction function is subtracted from the power term to control power control.

The method of producing a voiceless vowel when a speech segment is given as a CV (consonant-vowel) segment has been described above. However, the above operation is not limited to any specific speech segment, e.g., the CV segment. When the speech segment is larger than a CV segment, (e.g., a CVC segment; in this case, a consonant is connected to the vowel, or the consonants are to be connected to each other), a voiceless vowel can be obtained in the same method as described above.

An operation performed when a speech segment is given as a VCV segment (vowel-consonant-vowel segment), that is, when the vowels are connected at the time of speech segment connection, will be described with reference to FIGS. 26A and 26B.

Figure 26A:
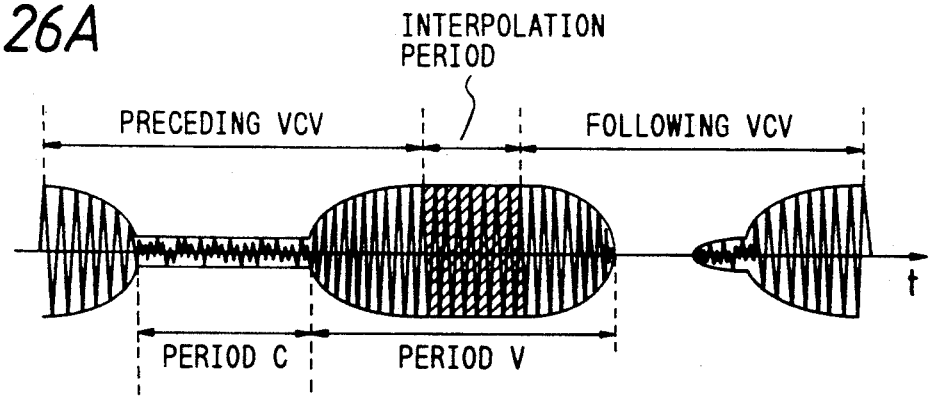
FIGS. 26A and 26B are views showing a change in a speech waveform when a voiceless vowel is present in a VCV segment.
Figure 26B:
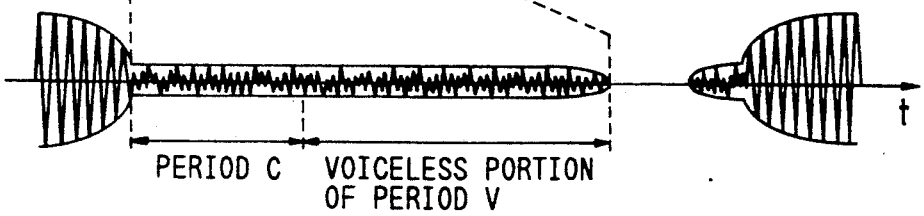

FIG. 26A shows a VCV segment including a voiceless period, and FIG. 26B shows a speech waveform for obtaining a voiceless portion of a speech period V.

This operation will be described with reference to FIGS. 26A and 26B. Speech segment data is extracted from the data base. When connection is performed using a VCV segment, vowel constant periods of the preceding VCV segment and the following VCV segment are generally interpolated to perform the connection, as shown in FIG. 26A. In this case, when a voiceless vowel is to be produced, a vowel between the preceding and following VCV segments is produced as a voiceless vowel. The VCV segment is located in accordance with a mora position. As shown in FIG. 26B, data of the vowel period V from the start of the vowel after the preceding VCV segment to the end of the vowel before the following VCV segment is changed to data of the consonant constant period C of the preceding VCV segment. As this method has been described in the first embodiment, the parameter of the consonant constant period C is linearly expanded to the end of vowel, and the sound source is given as a noise sound source to obtain a voiceless vowel period. If power control is required, the power can be controlled by the method described with reference to FIG. 1.

The voiceless vowel described above can be obtained in the arrangement shown in FIG. 1. The arrangement of FIG. 1 has been described before, and a detailed description thereof will be omitted.

A method of synthesizing phonemes to obtain a voiceless vowel as natural speech is not limited to the above method, but various changes and modifications may be made. For example, when a parameter of a vowel period is to be changed to a parameter of a consonant period, the constant period of the consonant is linearly expanded to the end of the vowel in the above method. However, the parameter of the consonant constant period may be partially copied to the vowel period, thereby substituting the parameters.

Storage of Speech Segment

Figure 27B:
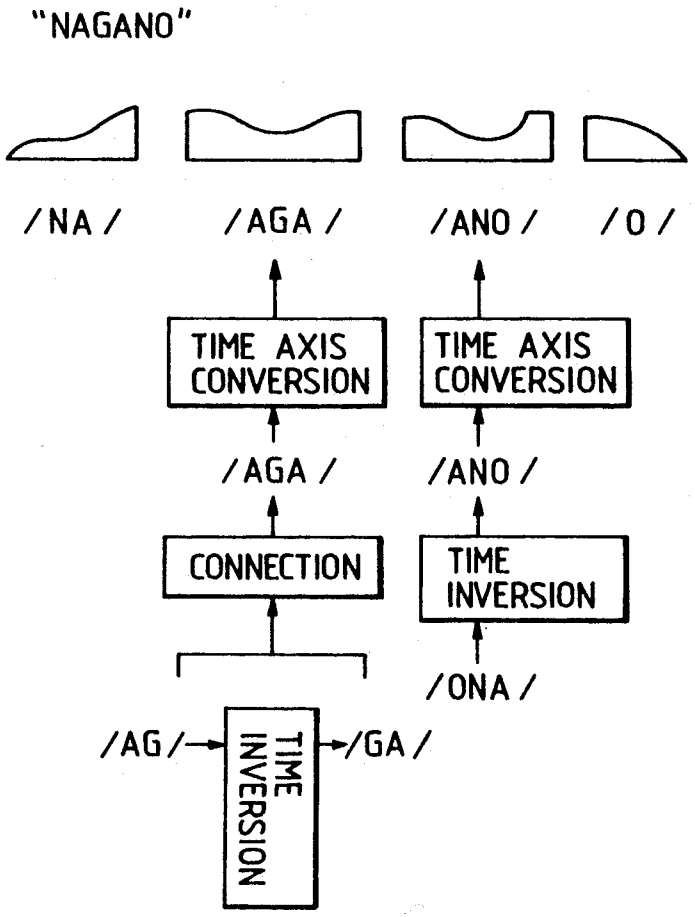
FIGS. 27A and 27B are views showing an operation by using a stored speech segment in a form inverted along a time axis.
Figure 27A:
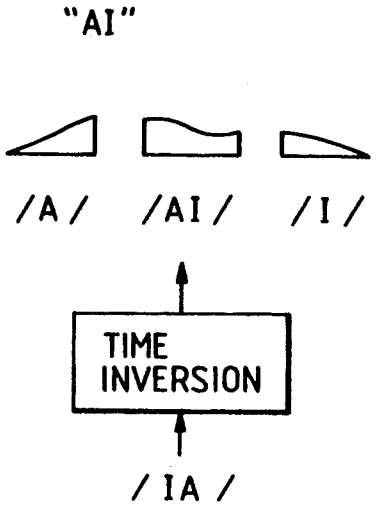

Necessary VCV segments must be prestored to generate a speech parameter series in order to perform speech synthesis. When all VCV combinations are stored, the memory capacity becomes very large. Various VCV segments can be generated from one VCV segment by time inversion and time-axis conversion, thereby reducing the number of VCV segments stored in the memory. For example, as shown in FIG. 27A, the number of VCV segments can be reduced. More specifically, a VV pattern is produced when a vowel chain is given in a VCV character train. Since the vowel chain is generally symmetrical about the time axis, the time axis is inverted to generate another pattern. As shown in FIG. 27A, an /AI/ pattern can be obtained by inverting an /IA/ pattern, and vice versa. Therefore, only one of the /IA/ and /AI/ patterns is stored. FIG. 27B shows an utterance "NAGANO" (the name of place in Japan). An /ANO/ pattern can be produced by inverting an /ONA/ pattern. However, in a VCV pattern including a nasal sound has a start duration of the nasal sound different from its end duration. In this case, time-axis conversion is performed using an appropriate time conversion function. An /AGA/ pattern is obtained such that an /AGA/ pattern as a VCV pattern is obtained by time-inverting and connecting the /AG/ or /GA/ pattern, and then the start duration of the nasal component and the end duration of the nasal component are adjusted with respect to each other. Time-axis conversion is performed in accordance with a table look-up system in which a time conversion function is obtained by DP and is stored in the form of a table in a memory. When time conversion is linear, linear function parameters may be stored and linear function calculations may be performed to covert the time axis.

Figure 28:
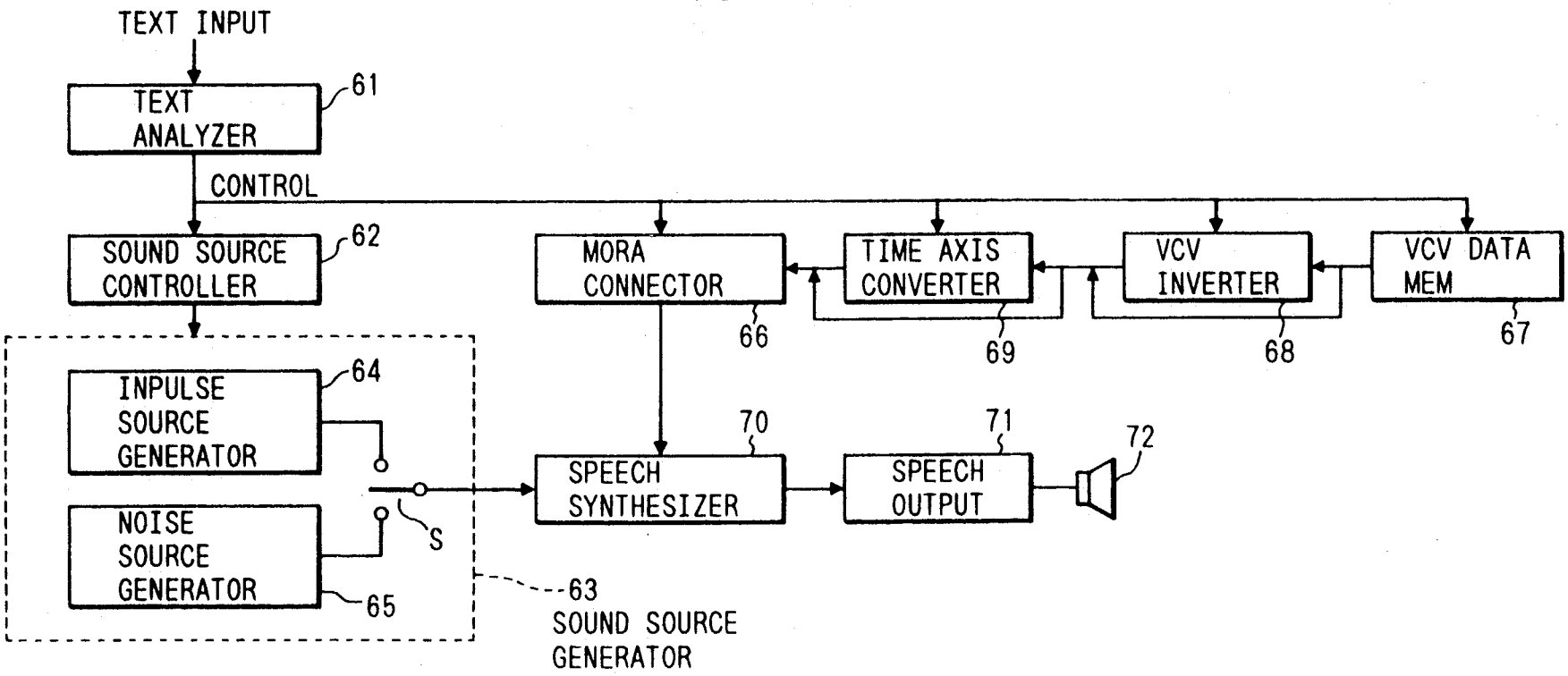
FIG. 28 is a block diagram showing an arrangement in which a stored speech segment is time-inverted and used.

FIG. 28 is a block diagram showing a speech synthesis arrangement using data obtained by time inversion and time-axis conversion of VCV data prestored in a memory.

Referring to FIG. 28, this arrangement includes a text analyzer 61, a sound source controller 62, a sound source generator 63, an impulse source generator 64, a noise source generator 65, a mora connector 66, a VCV data memory 67, a VCV data inverter 68, a time axis converter 69, a speech synthesizer 70 including a synthesis filter, a speech output 71, and a speaker 72.

Speech synthesis processing in FIG. 28 will be described below. A text represented by a character train for speech synthesis is analyzed by the text analyzer 61, so that changeover between voiced and voiceless sounds, high and low pitches, a change in connection time, and an order of VCV connections are extracted. Information associated with the sound source (e.g., changeover between voiced and voiceless sounds, and the high and low pitches) is sent to the sound source controller 62. The sound source controller 62 generates a code for controlling the sound source generator 63 on the basis of the input information. The sound source generator 63 comprises the impulse source generator 64, the noise source generator 65, and a switch for switching between the impulse and noise source generators 64 and 65. The impulse source generator 64 is used as a sound source for voiced sounds. An impulse pitch is controlled by a pitch control code sent from the sound source controller 62. The noise source generator 65 is used as a voiceless sound source. These two sound sources are switched by a voiced/voiceless switching control code sent from the sound source controller 62. The mora connector 66 reads out VCV data from the VCV data memory 67 and connects them on the basis of VCV connection data obtained by the text analyzer 61. Connection procedures will be described below.

The VCV data are stored as a speech parameter series of a higher order such as a mel cepstrum parameter series in the VCV data memory 67. In addition to the speech parameters, the VCV data memory 67 also stores VCV pattern names using phoneme marks, a flag representing whether inversion data is used (when the inversion data is used, the flag is set at "1"; otherwise, it is set at "0"), and a CVC pattern name of a VCV pattern used when the inversion data is to be used. The VCV data memory 67 further stores a time-axis conversion flag for determining whether the time axis is converted (when the time axis is converted, the flag is set at "1";

otherwise, it is set "0", and addresses representing the time conversion function or table. When a VCV pattern is to be read out, and the inversion flag is set at "1", an inversion VCV pattern is sent to the VCV inverter 68, and the VCV pattern is inverted along the time axis. If the inversion flag is set at "0", the VCV pattern is not supplied to the VCV inverter 68. If the time axis conversion flag is set at "1", the time axis is converted by the time axis converter 69. Time axis conversion can be performed by a table look-up system using a conversion table for storing conversion function parameters, thereby performing time axis conversion by function operations. The mora connector 66 connects VCV data output from the VCV data memory 67, the VCV inverter 68, and the time axis converter 69 on the basis of mora connection information.

A speech parameter series obtained by VCV connections in the mora connector 66 is synthesized with the sound source parameter series output from the sound source generator 63 by the speech synthesizer 70. The synthesized result is sent to the speech output 71 and is produced as a sound from the speaker 72.

An arrangement for performing the above processing by using a microprocessor will be described with reference to FIG. 29 below.

Figure 29:
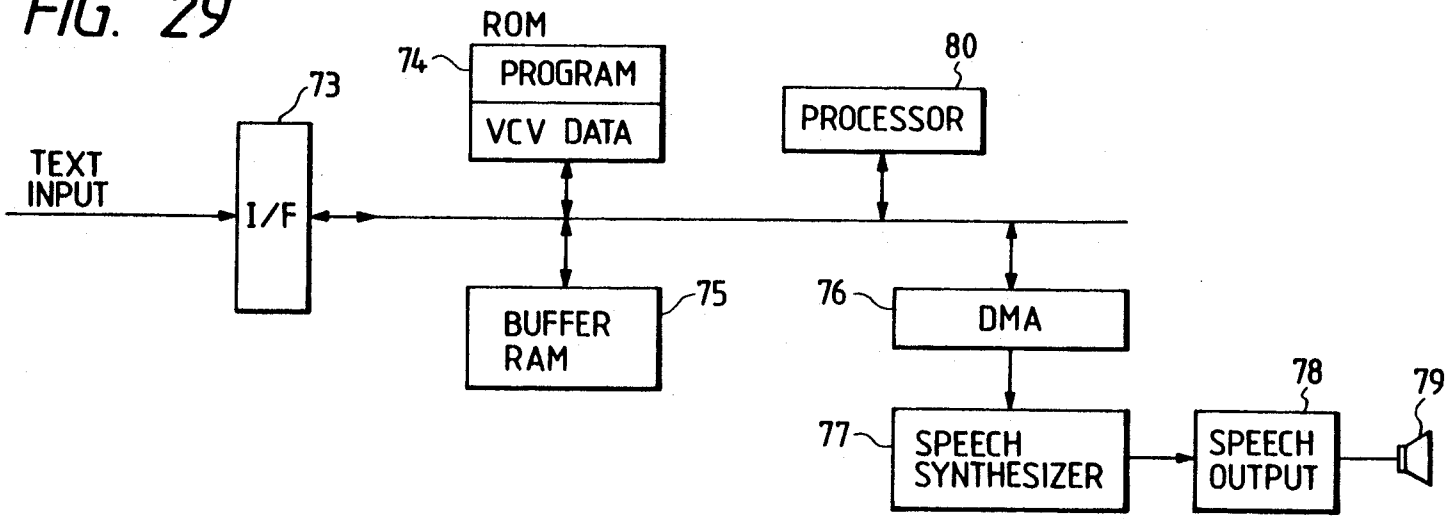
FIG. 29 is a block diagram showing an arrangement for performing speech synthesis of FIG. 28 by using a microprocessor.

Referring to FIG. 29, this arrangement includes an interface (I/F) 73 for sending a text onto a bus, a read-only memory (ROM) 74 for storing programs and VCV data, a buffer random access memory (RAM) 75, a direct memory access controller (DMA) 76, a speech synthesizer 77, a speech output 78 comprising a filter and an amplifier, a speaker 79, and a processor 80 for controlling the overall operations of the arrangement.

The text is temporarily stored in the RAM 75 through the interface 73. This text is processed in accordance with the programs stored in the ROM 74 and is added with a VCV connection code and a sound source control code. The resultant text is stored again in the RAM 75. The stored data is sent to the speech synthesizer 77 through the DMA 76 and is converted into speech with a pitch. The speech with a pitch is output as a sound from the speaker 79 through the speech output 78. The above control is performed by the processor 80.

In the above description, the VCV parameter series is exemplified by the Mel Cepstrum parameter series. However, another parameter series such as a PARCOR, LSP, and LPS Cepstrum parameter series may be used in place of the Mel Cepstrum parameter series. The VCV segment is exemplified as a speech segment. However, other segments such as a CVC segment may be similarly processed. In addition, when a speech output is generated by a combination of CV and VC segments, the CV pattern may be generated from the VC pattern, and vice versa.

Figure 30:
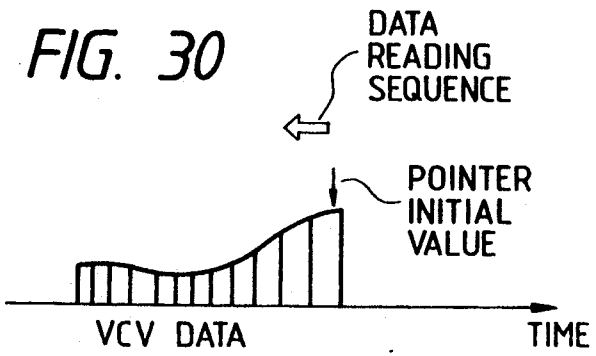
FIG. 30 is a view showing a concept for time-inverting and using a speech segment.

When a speech segment is to be inverted, the inverter need not be additionally provided. As shown in FIG. 30, a technique for assigning a pointer at the end of a speech segment and reading it from the reverse direction may be employed.

Text Input

The following embodiment exemplifies a method of synthesizing speech with a desired accent by inputting a speech accent control mark together with a character train when a text to be synthesized as speech is input as a character train.

Figure 31:
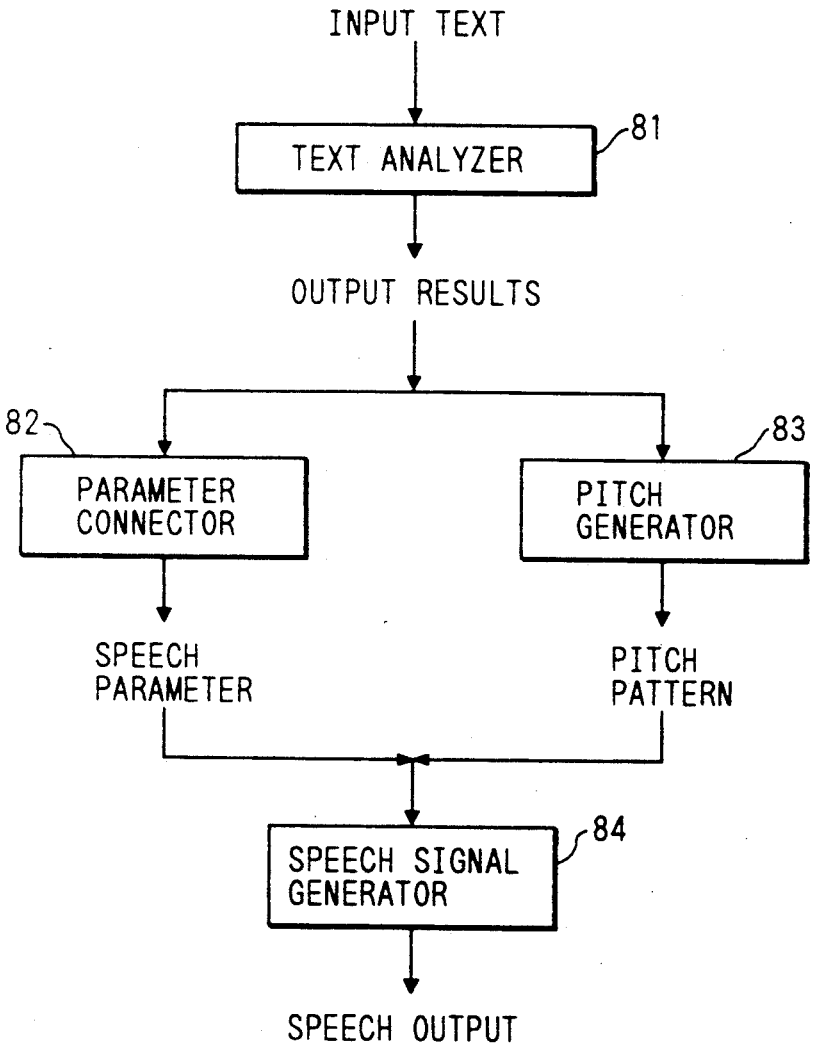
FIG. 31 is a block diagram showing an arrangement for inputting a speech synthesis power control signal and a text at the time of text input.

FIG. 31 is a block diagram showing an arrangement of this embodiment. This arrangement includes a text analyzer 81, a parameter connector 82, a pitch generator 83, and a speech signal generator 84. An input text consisting of Roman characters and control characters is extracted in units of VCV segments (i.e., speech segments) by the text analyzer 81. The VCV parameters stored as Mel Cepstrum parameters are expanded/reduced and connected by the parameter connector 82, thereby obtaining speech parameters. A pitch pattern is added to this speech parameter by the pitch generator 83. The resultant data is sent to the speech signal generator 84 and is output as a speech signal.

Figure 32:
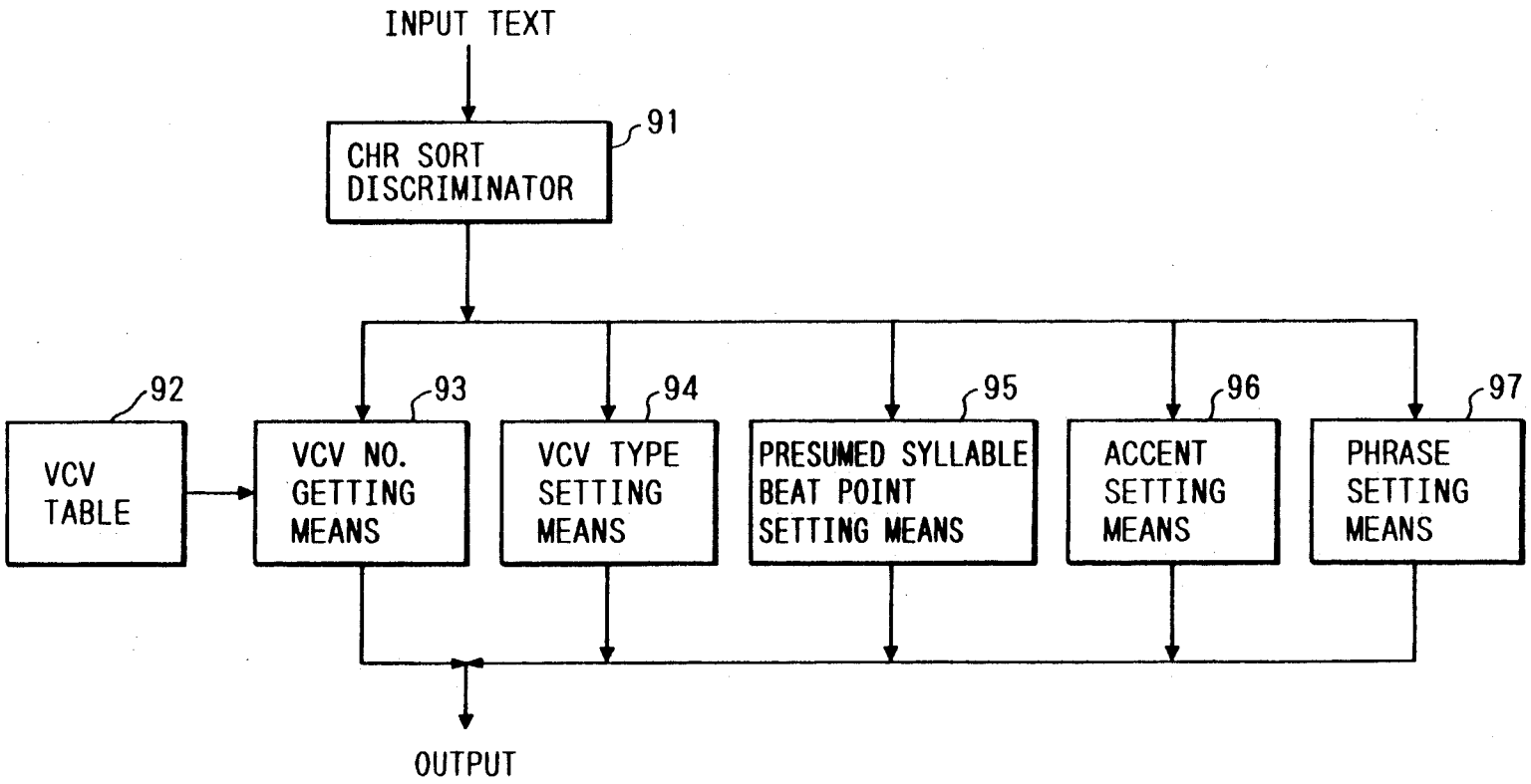
FIG. 32 is a block diagram showing a detailed arrangement of a text analyzer shown in FIG. 31.

FIG. 32 is a block diagram showing a detailed arrangement of the text analyzer 81. The type of character of the input text is discriminated by a character sort discriminator 91. If the discriminated character is a mora segmentation character (e.g., a vowel, a syllabic nasal sound, a long vowel, or a double consonant), a VCV table 92 for storing VCV segment parameters accessible by VCV Nos. in a VCV No. getting means 93 is accessed, and a VCV No. is set in the input text analysis output data. A VCV type setting means 94 sets a VCV type (e.g., voiced/voiceless, long vowel/double consonant, silence, word start/word end, double vowel, sentence end) so as to correspond to the VCV No. extracted by the VCV No. getting means 93. A presumed syllable beat point setting means 95 sets a presumed syllable beat point, and a phrase setting means 97 sets a phrase (breather).

This embodiment is associated with setting of an accent and a presumed syllabic beat point in the input analyzer 81. The accent and the presumed syllabic beat point are set in units of morae and are sent to the pitch generator 83. When the accent is set by the input text, for example, when a Tokyo dialogue is to be set, an input "hashi" (which means a bridge) is described as "HA/SHI", and an input "hashi" (which means chopsticks) is described as "/HA \ SHI". Accent control is performed by control marks "/" and " \". The accent is raised by one level by the mark "/", and the accent is lowered by one level by the mark " / ". Similarly, the accent is raised by two levels by the marks "//", and the accent is raised by one level by the marks "// \" or "/ \ /".

Figure 33:
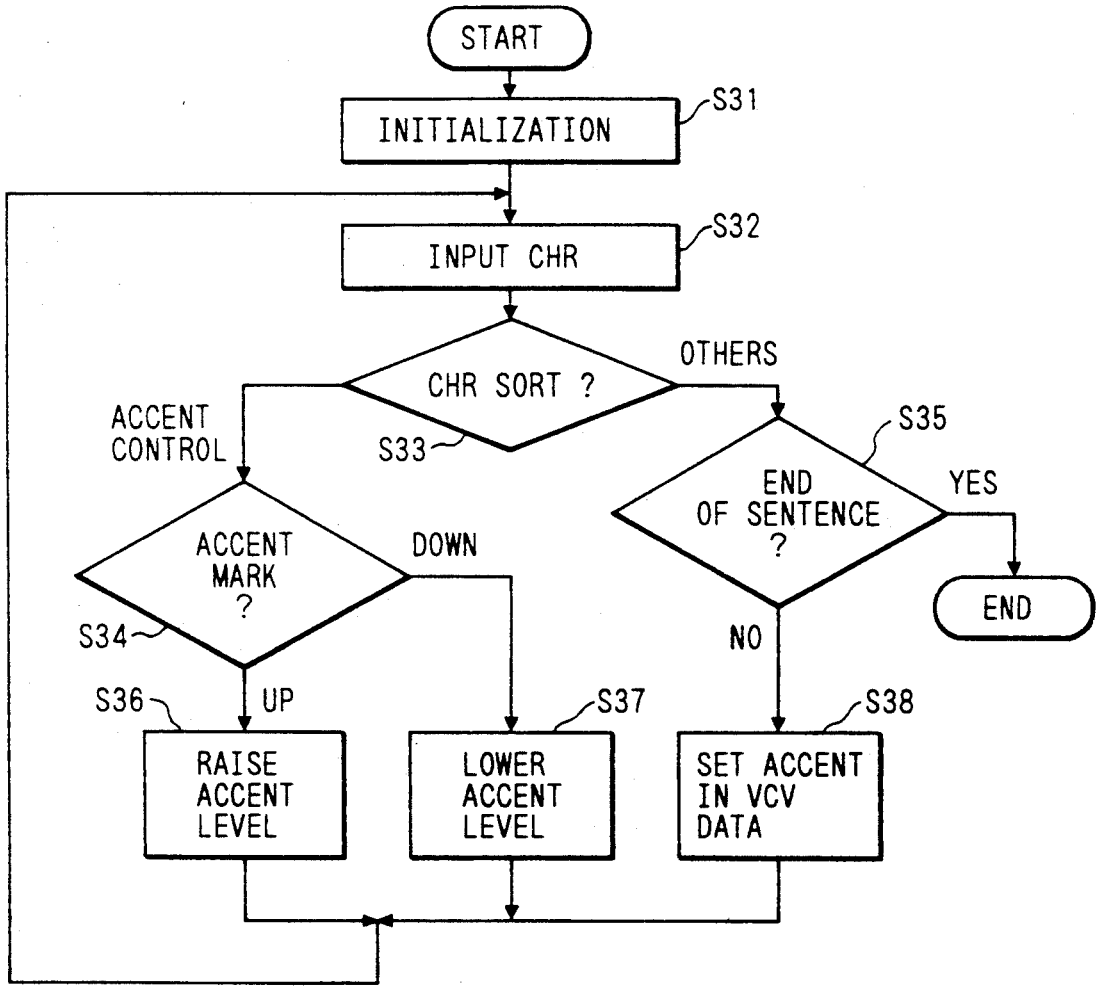
FIG. 33 is a flow chart for setting accents.

FIG. 33 is a flow chart for setting an accent. The mora No. and the accent are initialized (S31). An input text is read character by character (S32), and the character sort is determined (S33). If an input character is an accent control mark, it is determined whether it is an accent raising mark or an accent lowering mark (S34). If it is determined to be an accent raising mark, the accent is raised by one level (S36). However, if it is determined to be an accent lowering mark, the accent is lowered by one level (S37). If the input character is determined not to be an accent control mark (S33), it is determined whether it is a character at the end of the sentence (S35). If YES in step S35, the processing is ended. Otherwise, the accent is set in the VCV data (S38).

A processing sequence will be described with reference to the flow chart shown in FIG. 33 wherein an output of the text analyzer is generated when an input text "KO//RE \ WA \ //PE \ N \ /DE \ SU/KA/ ." is entered. The accent is initialized to 0 (S31).

A character "K" is input (S32) and its character sort is determined by the character sort discriminator 91 (S33). The character "K" is neither a control mark nor a mora segmentation character and is then stored in the VCV buffer. A character "O" is neither a control mark nor a mora segmentation character and is stored in the VCV buffer. The VCV No. getting means 93 accesses the VCV table 92 by using the character train "KO" as a key in the VCV buffer (S38). An accent value of 0 is set in the text analyzer output data in response to the input "KO", the VCV buffer is cleared to zero in the VCV buffer (S31). A character "/" is then input to the VCV buffer, and its type is discriminated (S33). Since the character "/" is an accent raising control mark (S34), the accent value is incremented by one (S36). Another character "/" is input to further increment the accent value by one (S36), thereby setting the accent value to 2. A character "R" is input and its character type is discriminated and stored in the VCV buffer. A character "E" is then input and its character type is discriminated. The character "E" is a Roman character and a segmentation character, so that it is stored in the VCV buffer. The VCV table is accessed using the character train "ORE" as a key in the VCV buffer, thereby accessing the corresponding VCV No. The input text analyzer output data corresponding to the character train "ORE" is set together with the accent value of 2 (S38). The VCV buffer is then cleared, and a character "E" is stored in the VCV buffer. A character " \ " is then input (S32) and its character type is discriminated (S33). Since the character " \ " is an accent lowering control mark (S34), the accent value is decremented by one (S37), so that the accent value is set to be 1. The same processing as described above is performed, and the accent value of 1 of the input text analyzer output data "EWA" is set. When (n+1) spaces are counted as n morae, the input "KO/RE \ WA \ //PE \ N \ /-DE \ SU/KA/. can be decomposed into morae as follows:

"KO"+"ORE"+"EWA"+"A"+"PE"+-
"EN"+"NDE"+"ESU"+"UKA"+"A"

and the accent values of the respective morae are set within the parentheses:

"*KO* (0)" + "*ORE* (2)" + "*EWA* (1)" + "*A* (0)" + "*PE* (2)" +

"*EN* (1)" + "*NDE* (1)" + "*ESU* (0)" + "*UKA* (1)" + "*A* (2)"

Figure 35:
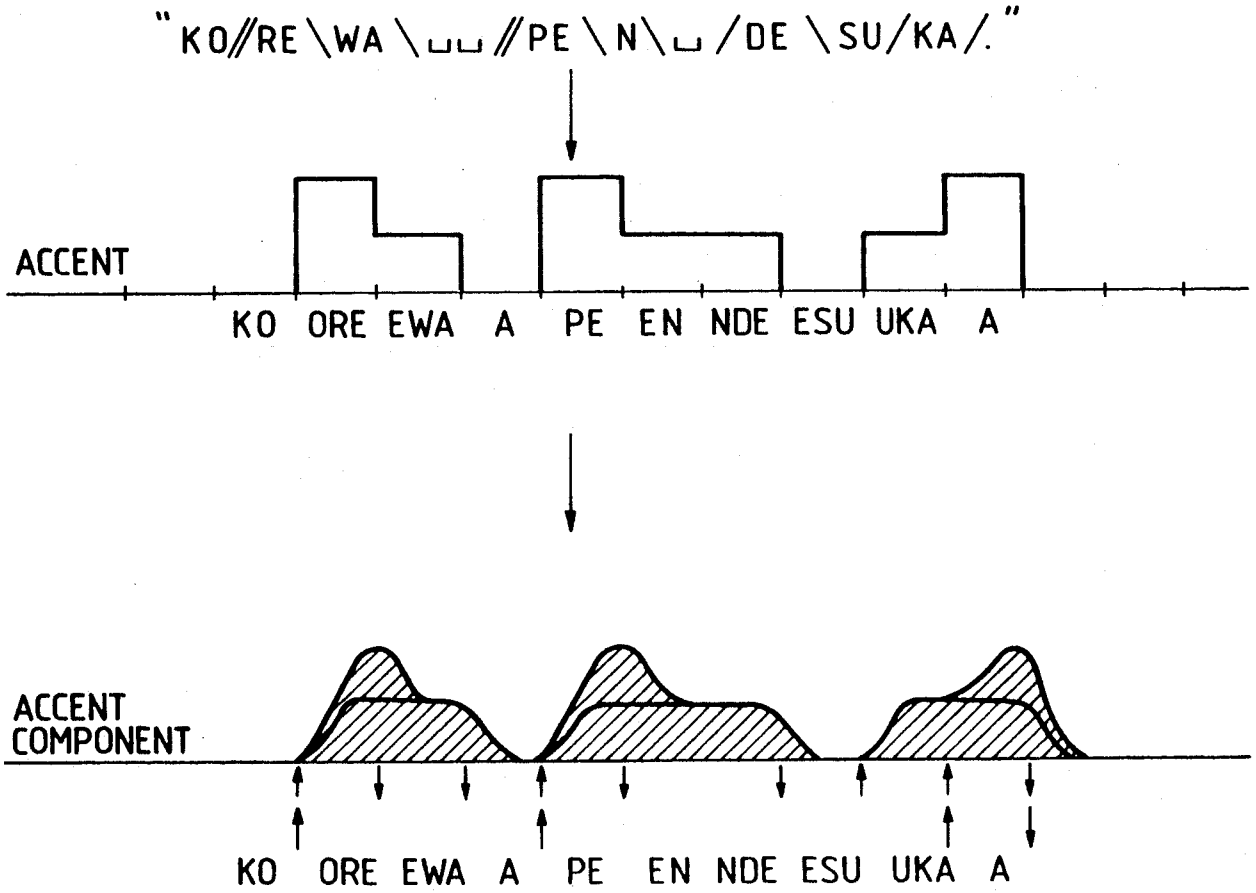
FIG. 35 is a view showing a speech synthesis power and an input text added with a power control signal.

The resultant mora series is input to the pitch generator 83, thereby generating the accent components shown in FIG. 35.

Figure 34:
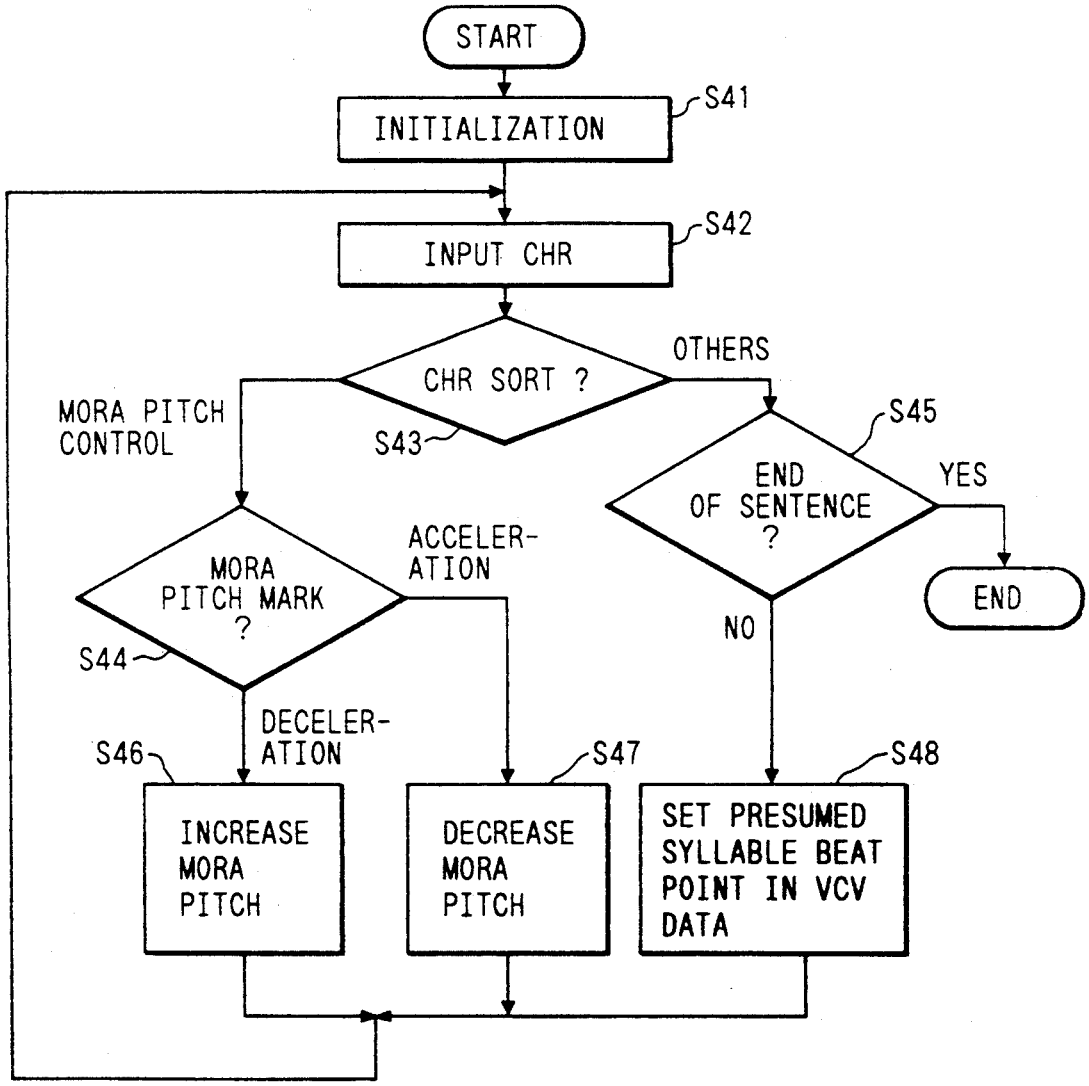
FIG. 34 is a flow chart for setting an utterance speed (mora length)

FIG. 34 is a flow chart for setting an utterance speed.

Control of the mora pitch and the utterance speed is performed by control marks "−" an "+" in the same manner as accent control. The syllable beat point pitch is decremented by one by the mark "−" to increase the utterance speed. The syllable beat point pitch is incremented by one by the mark "+" to decrease the utterance speed.

A character train input to the text analyzer 81 is extracted in units of morae, and a syllable beat point and a syllable beat point pitch are added to each mora. The resultant data is sent to the parameter connector 82 and the pitch generator 83.

The syllable beat point is initialized to be 0 (msec), and the syllable beat point pitch is initialized to be 96 (160 msec).

When an input "A+IU−−E−0" is entered, the input is extracted in units of morae. A presumed syllable beat point position (represented by brackets []) serving as a reference before a change is added by an utterance speed control code, and the next input text analyzer output data is generated as follows:

"A [16]"+"AI [33]+"IU [50]"+"UE [65]"+"EO [79]"+O [94]"

Setting of an utterance speed (mora pitch) will be described with reference to a flow chart in FIG. 34.

The syllable beat point is initialized to be 0 (msec), and the presumed syllable beat point is initialized to be 96 (160 msec) (S41). A text consisting of Roman letters and control marks is input (S42), and the input text is read character by character in the character type discriminator 91 to discriminate the character type or sort (S43). If an input character is a mora pitch control mark (S43), it is determined whether it is a deceleration or acceleration mark (S44). If the character is determined to be the deceleration mark, the syllable beat point pitch is incremented by one (S46). However, if the input character is determined to be the acceleration mark, the syllable beat point pitch is decremented by one (S47). When the syllable beat point pitch is changed (S46 and S47), the next one character is input from the input text to the character sort discriminator 91 (S42). When the character type is determined not to be a mora pitch control mark in step S43, it is determined to be located at the end of the sentence (S45). If NO in step S45, the VCV data is set without changing the presumed syllable beat point pitch (S48). However, if YES in step S45, the processing is ended.

When the syllable beat point pitch is changed in processing for setting the utterance speed, the position of the presumed syllable beat point is also changed.

Processing for the accent and speed change is performed in the CPU (Central Processing Unit).

What is claimed is:

1. A speech synthesis apparatus comprising:

a speech segment file for storing a plurality of segments, each segment comprising vowel-consonant-vowel information comprising a plurality of pieces of information including a parameter and sound source information;

memory means for storing a plurality of average powers of each vowel;

means for measuring a gap between powers of both ends of a vowel-consonant-vowel segment forming speech information and an average power of vowels at the both ends of the vowel consonant-vowel segment;

means for determining a normalization function for the vowel-consonant-vowel segment on the basis of the measured gap; and means for normalizing a power of the vowel-consonant-vowel segment in accordance with the determined normalization function and for outputting the speech information.

2. An apparatus according to claim 1, wherein said normalizing means normalizes the segment as a whole.

3. An apparatus according to claim 1, wherein said normalizing means normalizes only a vowel of the segment.

4. An apparatus according to claim 1, wherein said normalizing means adjusts the average power of each vowel in accordance with a power characteristic of a word or sentence and normalizes the power of the segment.

5. A speech synthesis method comprising the steps of:

storing a plurality of segments, each segment comprising vowel-consonant-vowel information comprising of a plurality of pieces of information including a parameter and sound source information;

storing a plurality of average powers of each vowel;

measuring a gap between powers of both ends of a vowel-consonant-vowel segment forming speech information and an average power of vowels at the both ends of the vowel-consonant vowel segment;

determining a normalization function for the vowel-consonant-vowel segment on the basis of the measured gap; and normalizing a power of the vowel-consonant-vowel segment in accordance with the determined normalization function and for outputting the speech information.

6. A method according to claim 5, wherein the step of normalizing the power of the vowel-consonant-vowel speech segment comprises performing normalization of the vowel-consonant-vowel speech segment as a whole.

7. A method according to claim 5, wherein the step of normalizing the power of the vowel-consonant-vowel speech segment comprises performing normalization of only a vowel of the vowel-consonant-vowel speech segment.

8. A method according to claim 5, wherein the step of normalizing the power of the vowel-consonant-vowel speech segment comprises adjusting the average power of each vowel in accordance with a power characteristic of a word or sentence of speech to be synthesized, and normalizing the power of the vowel-consonant-vowel speech segment.

9. A speech synthesis apparatus comprising:

a speech segment file for storing speech segments;

means for determining a vowel constant period in accordance with a function of an utterance speed of synthesized speech;

means for setting an expansion or reduction rate in response to the determined vowel constant period and types of speech segments and for expanding or reducing the speech segments stored in said speech segment file using the set expansion or reduction rate; and means for connecting the expanded or reduced speech segments to each other for synthesis of speech.

10. A speech synthesis method comprising the steps of:

storing speech segments;

determining a vowel constant period in accordance with a function of an utterance speed of synthesized speech;

setting an expansion or reduction rate in response to the determined vowel constant period and types of speech segments and for expanding or reducing the stored speech segments using the set expansion or reduction rate; and connecting the expanded or reduced speech segments to each other for synthesis of speech.

11. A speech synthesis apparatus comprising:

memory means for storing speech parameters by using a vowel-consonant-vowel speech segment as a basic unit according to which the speech parameters are stored;

first setting means for setting a syllable beat point pitch in accordance with an utterance speed of synthesized speech;

second setting means for setting an expansion or reduction rate of the speech parameters stored in said memory means in accordance with the type of the vowel-consonant-vowel speech segments with which the speech parameters are associated;

connecting means for expanding or reducing and connecting the speech parameters stored in said memory means in accordance with the expansion or reduction rate set by said second setting means; and synthesizing means for performing speech synthesis by using a normalization orthogonal filter, an exponential approximation filter, the stored speech parameters, the pitch set by said first setting means, and the rate set by said second setting means.

12. An apparatus according to claim 11, wherein the syllable beat point defines an utterance timing and is set so that a pitch between a given syllable beat point and the next syllable beat point has a predetermined value corresponding to the utterance speed.

13. An apparatus according to claim 11, wherein the expansion or reduction rate of the speech parameters is determined in accordance with whether a vowel-consonant-vowel speech segment represented by the speech parameter tends to be changed in accordance with a change in utterance speed.

14. An apparatus according to claim 11, wherein said normalization orthogonal filter used in said synthesizing means has characteristics in which a volume of information is increased in a low-frequency spectral range.

15. A method of performing speech synthesis, comprising the steps of:

storing speech parameters by using a vowel-consonant-vowel speech segment as a basic unit according to which the speech parameters are stored;

setting an expansion or reduction rate of the speech parameter in accordance with a syllable beat point pitch corresponding to an utterance speed of synthesized speech and the type of vowel-consonant-vowel speech segments with which the speech parameters stored in said storing step are associated; and synthesizing the speech parameter at the set expansion or reduction rate by using a normalization orthogonal filter, an exponential approximation filter.

16. A method according to claim 15, wherein the syllable beat point defines an utterance timing and is set so that a pitch between a given syllable beat point and the next syllable beat point has a predetermined value corresponding to the utterance speed.

17. A method according to claim 15, wherein the expansion or reduction rate of the speech parameters is determined in accordance with whether a vowel-consonant-vowel speech segment represented by the speech parameter tends to be changed in accordance with a change in utterance speed.

18. A method according to claim 15, wherein the normalization orthogonal filter used in the synthesizing step has characteristics in which a volume of information is increased in a low-frequency spectral range.

19. A speech synthesis apparatus comprising:

means for inputting a text;

means for analyzing the inputted text and for separating speech segment information and control information from each other in the text;

means for synthesizing speech; and means for controlling said synthesizing means to synthesize speech based on the separated speech segment information in accordance with the separated control information.

20. A speech synthesis method comprising the steps of:

inputting a text into a speech synthesis apparatus;

analyzing the inputted text and for separating speech segment information and control information from each other in the text;

synthesizing speech with the speech synthesis apparatus; and controlling said synthesizing step to synthesize speech based on the separated speech segment information in accordance with the separated control information.

21. A speech synthesis apparatus comprising:

means for detecting a voiceless vowel from synthesized speech information;

means for converting a parameter of the detected voiceless vowel into a parameter of a consonant; and means for controlling said apparatus such that a noise is used as a sound source for a speech period of the detected voiceless vowel.

22. An apparatus according to claim 21, further comprising means for determining whether a vowel to be synthesized is to be a voiceless vowel on the basis of a relation between a speech segment of a vowel and a speech segment preceding or following the vowel.

23. An apparatus according to claim 21, wherein said converting means obtains the parameter of the voiceless vowel by expanding the parameter of the consonant immediately preceding the voiceless vowel to a vowel period.

24. An apparatus according to claim 21, wherein said converting means obtains the parameter of the voiceless vowel by changing the parameter of the consonant immediately preceding the voiceless vowel to a vowel period.

25. A speech synthesis method comprising the steps of:

detecting a voiceless vowel from synthesized speech information;

converting a parameter of the detected voiceless vowel into a parameter of a consonant; and controlling a speech synthesis apparatus such that a noise is used as a sound source for a speech period of the detected voiceless vowel.

26. A method according to claim 25, wherein the voiceless vowel is determined on the basis of a relation between a speech segment of a vowel and a speech segment preceding or following the vowel.

27. A method according to claim 25, wherein the parameter of the voiceless vowel is converted by expanding the parameter of the immediately preceding consonant to a vowel period.

28. A method according to claim 25, wherein the parameter of the voiceless vowel is converted by changing the parameter of the immediately preceding consonant to a vowel period.

29. A speech synthesis apparatus comprising;

means for receiving a character train;

sound source generating means for generating a sound source corresponding to the input character train;

means for identifying segments of speech;

means for generating a speech segment parameter series;

means for inverting the speech segment parameter series corresponding to the input character train along a time axis;

connecting means for obtaining a speech parameter series by connecting the speech segments;

means for synthesizing the speech using the speech parameter series and an output from said sound source generating means.

30. An apparatus according to claim 29, further comprising means for inverting the speech segment parameter series along a time axis.

31. An apparatus according to claim 29, further comprising means for converting the time axis of the speech segment parameter series linearly or nonlinearly when the speech segment parameter series is inverted along the time axis.

32. A speech synthesis method comprising the steps of:

inputting a character train into a speech output apparatus;

generating sound source information corresponding to the input character train;

identifying speech segments of the sound source information corresponding to the input character train and a parameter series of the speech segments;

inverting the parameter series of the speech segments corresponding to the input character train along a time axis;

connecting the inverted parameter series to obtain a speech parameter series;

synthesizing the speech parameter series with an output from sound source generating means; and outputting speech from the speech output apparatus using the speech parameter series.

33. A method according to claim 32, further comprising the step of determining whether the parameter series of the speech segments is to be inverted along the time axis.

34. A method according to claim 32, further comprising the step of converting the time axis of the parameter series linearly or nonlinearly when the speech segment parameter series is inverted along the time axis.

* * * * *

UNITED STATES PATENT AND TRADEMARK OFFICE

CERTIFICATE OF CORRECTION

PATENT NO. : 5,220,629

DATED : JUNE 15, 1993

INVENTOR(S) : TETSUO KOSAKA, ET AL.

It is certified that error appears in the above-indentified patent and that said Letters Patent is hereby corrected as shown below:

IN THE DRAWINGS

Sheet 23, in the box labeled "64", "INPULSE" should read --IMPULSE--.

COLUMN 3

Line 66, "periods," should read --period,--.

Line 68, "more" should read --mora--.

COLUMN 7

Line 11, "define" should read --defined as a--.

Line 25, "a case" should read --the case of--.

Line 59, "function" should read --function.--.

COLUMN 9

Line 41, "(3) mh $\leq$ M," should read --(3) if mh $\leq$ M,--.

Line 53, "V=vm+a(M-m()" should read --V=vm+a(M-ml)--.

COLUMN 13

Line 21, "synthesize" should read --synthesized--.

Line 45, "bet" should read --beat--.

COLUMN 18

Line 58, "mel cepstrum" should read --Mel Cepstrum--.

COLUMN 19

Line 1, "set "0"," should read --set at "0"),--.

COLUMN 20

Line 19, "Nos." should read --numbers--; and "No." should read --number--.

Line 20, "No." should read --number--.

UNITED STATES PATENT AND TRADEMARK OFFICE

CERTIFICATE OF CORRECTION

PATENT NO. : 5,220,629

DATED : JUNE 15, 1993

INVENTOR(S) : TETSUO KOSAKA, ET AL.

It is certified that error appears in the above-indentified patent and that said Letters Patent is hereby corrected as shown below:

Line 24, "No." should read --number--.
Line 25, "No." should read --number--.
Line 34, "dialogue" should read --accent--.
Line 40, "mark "/"." should read --mark "\".--.
Line 45, "No." should read --number--.

COLUMN 21

Line 2, "No." should read --number--.
Line 20, "No." should read --number--.
Line 33, "DE\SU/KA/." should read --DE\SU/KA/."--.
Line 67, "brackets □)" should read --brackets [ ])--.

COLUMN 23

Line 3, delete "of".

COLUMN 24

Line 45, "an" should read --and an--.

Signed and Sealed this

Nineteenth Day of April, 1994

Bruce Lehman

*Attest:*

BRUCE LEHMAN

*Attesting Officer*

*Commissioner of Patents and Trademarks*